US012778298B2

(12) United States Patent
Horst et al.

(10) Patent No.: US 12,778,298 B2
(45) Date of Patent: Nov. 3, 2026

(54) MODULAR COLUMNAR MOUNTING SYSTEM

(71) Applicant: Roar Holdings LLC, Loveland, CO (US)

(72) Inventors: Clayton Horst, Loveland, CO (US); Jon Von Vogueman, Lakewood, CO (US)

(73) Assignee: ROAR Holdings LLC, Loveland, CO (US)

( * ) Notice: Subject to any disclaimer, the term of this patent is extended or adjusted under 35 U.S.C. 154(b) by 0 days.

(21) Appl. No.: 19/330,731

(22) Filed: Sep. 16, 2025

(65) Prior Publication Data

US 2026/0083242 A1 Mar. 26, 2026

Related U.S. Application Data

(60) Provisional application No. 63/697,422, filed on Sep. 20, 2024.

(51) Int. Cl.

| | |
|---|---|
| ***A47B 96/00*** | (2006.01) |
| ***A47B 57/48*** | (2006.01) |
| ***A47B 96/02*** | (2006.01) |
| ***E04H 12/18*** | (2006.01) |
| ***E04H 12/22*** | (2006.01) |

(52) U.S. Cl.

CPC ..... *A47B 96/027* (2013.01); *A47B 57/48* (2013.01); *E04H 12/185* (2013.01); *E04H 12/2238* (2013.01); *A47B 2220/0091* (2013.01)

(58) Field of Classification Search

None

See application file for complete search history.

(56) References Cited

U.S. PATENT DOCUMENTS

| | | | | |
|---|---|---|---|---|
| 1,401,057 | A * | 12/1921 | Elliott | A47B 87/0223 211/188 |
| 3,951,079 | A * | 4/1976 | Tolleson | A47F 5/02 108/94 |
| 5,458,243 | A * | 10/1995 | McBride | A47B 87/0261 211/196 |
| 5,806,464 | A | 9/1998 | Willinger et al. | |
| 6,966,277 | B2 | 11/2005 | DeRaspe-Bolles et al. | |
| 8,276,524 | B2 * | 10/2012 | Goode | A47G 19/00 108/94 |

(Continued)

OTHER PUBLICATIONS

CatVantage, DesignWerks, Inc. [online]. Retrieved from the Internet: <URL: http://www.catvantage.net/794/index.html>, [retrieved on Jan. 22, 2026], 5 pages.

(Continued)

*Primary Examiner* — Steven M Marsh

(74) *Attorney, Agent, or Firm* — David C. Eyvazzadeh

(57) ABSTRACT

A modular mounting device and system for interconnecting accessories to a structure to provide modularity and adjustability for a variety of applications. In some embodiments a column is configured to interconnect with a column receiver. In some embodiments an accessory ring is configured to interconnect with a column. In some embodiments, an accessory is configured to interconnect with an accessory ring. In some embodiments, the interconnection of one or more elements results in the digital and/or electrical interconnection between the interconnected elements.

20 Claims, 19 Drawing Sheets

(56) References Cited

U.S. PATENT DOCUMENTS

| | | | | |
|---|---|---|---|---|
| D702,891 | S | 4/2014 | Yang et al. | |
| 8,720,349 | B1 * | 5/2014 | David | A47B 37/04 211/133.4 |
| 10,080,336 | B2 * | 9/2018 | Higgins | A01G 31/06 |
| 12,369,541 | B2 * | 7/2025 | Higgins | A01G 31/02 |
| 2010/0154686 | A1 * | 6/2010 | Loebner | A47B 87/0246 108/59 |
| 2015/0296726 | A1 * | 10/2015 | Higgins | A01G 31/06 47/62 R |
| 2016/0106067 | A1 | 4/2016 | Wedertz | |

OTHER PUBLICATIONS

The Hollywood Franklin Tower, Franklin Cat Furniture [online]. Retrieved from the Internet: <URL: https://franklincatfurniture.com/ >, [retrieved on Jan. 22, 2026], 6 pages.

* cited by examiner

SECTION A-A

SECTION B-B 3030
3150'
1110
3150
DETAIL D

D
1100
3000
SECTION C-C 1170
1100
1160
3000
C
1160
C
3100

SECTION E-E

SECTION E-E

SECTION J-J

SECTION N-N

MODULAR COLUMNAR MOUNTING SYSTEM

CROSS REFERENCE TO RELATED APPLICATIONS

This application claims the benefit of U.S. Provisional Application No. 63/697,422, filed Sep. 20, 2024, the content of which is herein incorporated by reference in its entirety for all purposes.

FIELD OF THE INVENTION

The present disclosure is directed to a columnar mounting system configured for the interconnection of accessories to a columnar structure. Columnar mounting systems, components, and methods are generally described. The mounting system as disclosed herein is intended for use in the construction and modular adjustment applications including, but not limited to, the construction of: a modular cat tree, Christmas tree, a storage rack for recreational items such as bicycles or ski gear, a display rack, point of sale display, and a mounting system for items such as lighting or electronic devices including audio/visual equipment.

BACKGROUND

Columnar structures are used in a variety of industries ranging from devices for personal use, such as the construction of a cat tree, the mounting of bicycles in a home, horticultural purposes such as for the purposes of a garden, or as a hat and coat rack. Furthermore, the use of a columnar structure extends to commercial uses such as for a point-of-sale unit, mounting of electronics such as lighting or cameras, medical devices, or signage.

The common limiting factor of the use of traditional structures for such purposes is that the columnar structure is limited in use to the structure as manufactured. Furthermore, existing columnar structures, (e.g., cat trees, display structures, and/or storage structures) lack electrical power and electronic connectivity thereto.

Therefore, there is an identified need for a columnar system which allows the modular and adjustable interconnection of accessories to a column to allow the customization of, adjustment of, and addition of electrical power and electronic connectivity to such structures described herein as desired.

SUMMARY

Columnar mounting systems, components, and methods are generally described. A columnar mounting system as disclosed herein comprises a column interconnected with a ground surface, and an accessory ring configured to mount to the column wherein the accessory ring is configured to be adjustable along the axis of the column and rotatively adjustable in relation to the column. While embodiments discussed and displayed herein involve a column mounted to a ground surface, embodiments wherein the column is mounted to a wall surface, ceiling, or other existing surface are within the spirit and scope of the present disclosure.

In some embodiments, a base comprises a column receiver configured to receive an end of the column therein for the interconnection of the base to the column. The base of certain embodiments comprises a bottom surface configured to rest upon a ground surface to support the column in a vertical or other desired orientation, while in alternative embodiments the base is affixed with a ground surface. However, embodiments wherein the column is interconnected directly with a ground surface or other supporting structure are within the spirit and scope of the present disclosure. While embodiments described herein surround a column held in a vertical orientation, the use of "column" or "columnar" are not limited to a vertical orientation herein. A column optionally includes embodiments of a structure held in a horizontal orientation, or an orientation between a horizontal and vertical orientation. Embodiments including one or more of a post, rail, panel, frame, and/or overhead track are within the spirit and scope of the present disclosure.

It is an aspect of certain embodiments for the column receiver to receive and be interconnected with the column without requiring tools for interconnecting and securing the column with the column receiver. Embodiments comprising a connection between the column and column receiver comprising magnets, electronic locking mechanisms, mechanical connections and the like are within the spirit and scope of the present disclosure.

The column receiver of certain embodiments can be interconnected and secured to a column at the base of the column, while alternative embodiments wherein the column receiver is interconnected to a top or medial aspect of the column are within the spirit and scope of the present disclosure.

It is an aspect of the present disclosure to allow the modular interconnection of an accessory ring to the column wherein the accessory ring is adjustable longitudinally along the longitudinal axis of the column, and wherein the accessory ring is rotationally adjustable about the longitudinal axis of the column. In some embodiments the accessory ring is rotationally adjustable about the longitudinal axis by virtue of the angular orientation in which the accessory ring is mounted to the column.

It is an aspect of certain embodiments to allow the rotational adjustment of the accessory ring about the longitudinal axis of the column wherein the accessory ring remains interconnected to the column during the rotational adjustment. In some embodiments a first portion of the accessory ring remains rotationally static to the column, and a second portion of the accessory ring is able to rotate about the axis of the column. In some embodiments an accessory is interconnected to the second portion of the accessory ring wherein the accessory is rotationally adjustable in about the longitudinal axis of the column without requiring longitudinal movement of the accessory ring along the column.

It is an aspect of the present disclosure to allow the longitudinal adjustment of the accessory ring along the longitudinal axis of the column without requiring tools. In some embodiments a lever is interconnected to a longitudinal adjustment release, wherein in a locked configuration, the accessory ring is unable to move longitudinally along the column, and wherein in an unlocked configuration, the accessory ring is free (e.g., unrestricted) to move longitudinally along the length of the column.

It is an aspect of the present disclosure to allow the rotational adjustment of the accessory ring about the longitudinal axis without requiring tools. In some embodiments a lever is interconnected to a rotational adjustment release, wherein in a locked configuration, the accessory ring is unable" to rotate about the longitudinal axis of the column, and wherein in an unlocked configuration, the accessory ring is free (e.g., unrestricted) to rotate about the longitudinal axis of the column.

It is an aspect of certain embodiments of the present disclosure to provide longitudinal mechanical stops, such as a hole or notch for interaction with a detent mechanism, wherein the accessory ring can be adjusted in predetermined increments longitudinally along the column.

It is an aspect of certain embodiments to provide angular mechanical stops, such as a hole or notch for interaction with a detent mechanism, wherein a second portion of the accessory ring is adjustable about the first portion of the accessory ring in predetermined angular increments.

It is an aspect of the present disclosure to allow a user to modularly interconnect objects to the column such as, but not limited to: a platform, camera mount, lighting mount, photovoltaic panels, hook, signage, RFID reader, plants, speakers, a projector, a pet treat dispenser, a display, a point-of-sale display, a kiosk, ornaments, storage accessories, or a book holder. Further embodiments comprise a pet laser device for entertaining pets wherein the laser can be controlled manually, automatically, or remotely through an application loaded on a remote computing device. Further embodiments still comprise a workstation element configured as a workstation wherein a user can place objects such as their computer, phone, work light, writing surface, and/or printer.

It is an aspect of the present disclosure to be used in conjunction with displays such as holographic visuals, visual aids, and interaction therewith. In some embodiments it may be desired to interconnect holographic projectors which are projected upon surfaces interconnected with the column, or upon the ground surface. Furthermore, it may be desired to interconnect motion and proximity sensors to the column to sense, detect, and communicate interactions that users have with the projected hologram. Further still, the sensors may be arranged in a manner to detect individuals within range wherein the hologram is programmed to initiate interactions with individuals within a predetermined range of the hologram.

In some embodiments the accessory ring is configured to receive an object wherein the accessory ring comprises a slot configured to receive a portion of the platform, thereby supporting the platform in a desired orientation such as a horizontal or other angled orientation. The platform can be used for the display or servicing of products, or can be used as a platform for a cat when the system is intended as a cat tree for instance.

It is an aspect of certain embodiments of the present disclosure to provide electrical power or data/communications connectivity through the column, and into an accessory ring interconnected with the column. For instance, an accessory ring comprising a light bulb or other lighting element which is interconnected with the column, can provide electrical power and data/communications from the column, and to the lighting element. Similarly, other electrical devices such as a phone charger, display, RFID tracking and inventory control devices, digital scale, and other electrically powered devices can be interconnected with the column so as to draw power and communications therefrom. The use of RFID tracking technology in some embodiments is used for the tracking of activity of an animal such as a household pet with a collar having an RFID embedded therein, while alternative embodiments use RFID tracking technology for inventory control, inventory monitoring, personnel activity tracking, and theft protection. For instance, a modular columnar mounting system can be erected for use as a short-term tool tracking system at a construction site, or within a warehouse for inventory tracking at strategic locations. In some embodiments, an accessory ring is adapted to interconnect a solar panel or photovoltaic panel to the column for orientation toward a light source such as the sun as well as provide electrical power connectivity.

It is an aspect of certain embodiments of the present disclosure that a column is electronically connected to a computing device, and wherein any accessory ring interconnected to the column is further connected with the computing device. For instance, a diagnostic device such as a scale can be used in conjunction with a cat tree configuration. The scale, when stood upon or laid upon by a cat would sense the weight of the cat and relay the data to the computing device to record or apply in the assessment of the health of the cat. Similarly, devices configured to detect vitals such as blood pressure, heart rate, and body temperature can be interconnected to the column for recording and assessment of the health of an animal or human. In some examples, an accessory (e.g., platform), accessory ring, column, and/or column receiver includes one or more sensors corresponding to load sensing, presence sensing, light sensing, motion sensing, electrical signal sensing (e.g., device continuity, and/or bioelectrical signals), and/or electrical resistance sensing as related to device signals and/or bioelectrical signals.

In some embodiments a column receiver is configured to interconnect with the base of the column for support wherein the column receiver comprises a computing device, wireless or wired communication capabilities, and a connection to a power supply.

In some embodiments a column receiver is configured to receive the column to affix the column to a structure or ground. In some examples, the column and/or column receiver is adapted for mobility (e.g., with wheels) for transportability within a given environment (e.g., hospital, home, outdoors, etc.) corresponding to a particular use.

It is an aspect of certain embodiments of the present disclosure to leverage the use of Artificial Intelligence (AI) in conjunction with the processing, detection, and display of data in a manner aligned with the intended use. In some embodiments, the column and/or the accessory ring optionally includes a display and/or light-emitting layer (e.g., LEDs, and/or flexible screen layer) for visual communication of information. In some examples, the light-emitting layer includes one or more individually addressable pixels, zones and/or LEDs. In some examples, the column receiver, accessory ring, and/or column includes a driver configured to communicate with the display and/or light-emitting layer. For instance, when the column is used as a cat tree, AI can be used to interpret and interpolate data to determine the mood, overall health, and identifiable health concerns of the cat through collected data such as weight, temperature, heart rate, activity level, litter box use and other detectable traits and data. When the column is used as a display model for instance, AI can be used to deduce interests of a nearby individual through identifiable physical traits and/or through electronic detection of a personal electronic device which provides identifying personal or demographic information. Furthermore, when used as a display, AI can be used in conjunction with sensors to help identify and optimize preferred display configurations, screen height, screen settings, and other physical and electronic settings which serve to enhance and optimize user engagement and resulting sales. Embodiments described herein optionally correspond to use in environments such as, but not limited to, retail service (e.g., bike repair stand), hospitality, medical, clinical, audio visual, and/or industrial applications.

In some embodiments, the accessory ring provides electrical interconnection with one or more system elements, thereby providing power and/or digital communication between an accessory and the column and/or the column receiver. In some examples, power and/or digital communication cables are internally routed within the column, wherein interconnection of the accessory ring with the column results in power and/or digital communication being provided to the accessory ring and/or the accessory. In some examples, the electrical and/or digital communication connections between one or more of the accessory, accessory ring, column, and/or column receiver are achieved via one or more electrical interfaces. Electrical interfaces optionally include one or more electrical connectors such as one or more slip rings, bus bars, spring contacts, pogo pin contacts, inductive coils, and/or wireless communication devices.

These and other advantages will be apparent from the disclosure of the embodiments contained herein. The above-described embodiments, objectives, and configurations are neither complete nor exhaustive. As will be appreciated, other embodiments of the present disclosure are possible using, alone or in combination, one or more of the features set forth above or described in detail below. Further, this Summary is neither intended nor should it be construed as being representative of the full extent and scope of the present disclosure. The present disclosure is set forth in various levels of detail in this Summary, as well as in the attached drawings and the detailed description below, and no limitation as to the scope of the present disclosure is intended to either the inclusion or non-inclusion of elements, components, etc. in this Summary. Additional aspects of the present disclosure will become more readily apparent from the detailed description, particularly when taken together with the drawings, and the claims provided herein.

DETAILED DESCRIPTION OF VARIOUS EMBODIMENTS

Certain embodiments of the present disclosure, as shown in FIG. 1-FIG. 3B for instance, comprise a modular columnar mounting system 1000 comprising a column 1100 configured to receive at least one accessory mounting device (e.g., accessory ring 2000). The column 1100 comprises a consistent cross-section and/or outer profile 1130 wherein an accessory ring 2000 is slidably adjustable along a length 1140 of the column. The accessory ring 2000 comprises an opening 2030 configured to receive the outer profile 1130 of the column. While embodiments of the column 1100 as shown herein comprise a round outer profile 1130, embodiments comprising channels or other cavities in an outer surface of the column are within the spirit and scope of the present disclosure. Furthermore, embodiments comprising a column 1100 having a triangular, square, hexagonal, octagonal, or polygonal shaped outer profile 1130 are within the spirit and scope of the present disclosure. While in some embodiments a column 1100 comprising a round outer profile is preferred, embodiments comprising an outer profile 1130 having a polygonal shape, elliptical shape, or other functional or ornamental shape are within the spirit and scope of the present disclosure.

Figure 4:
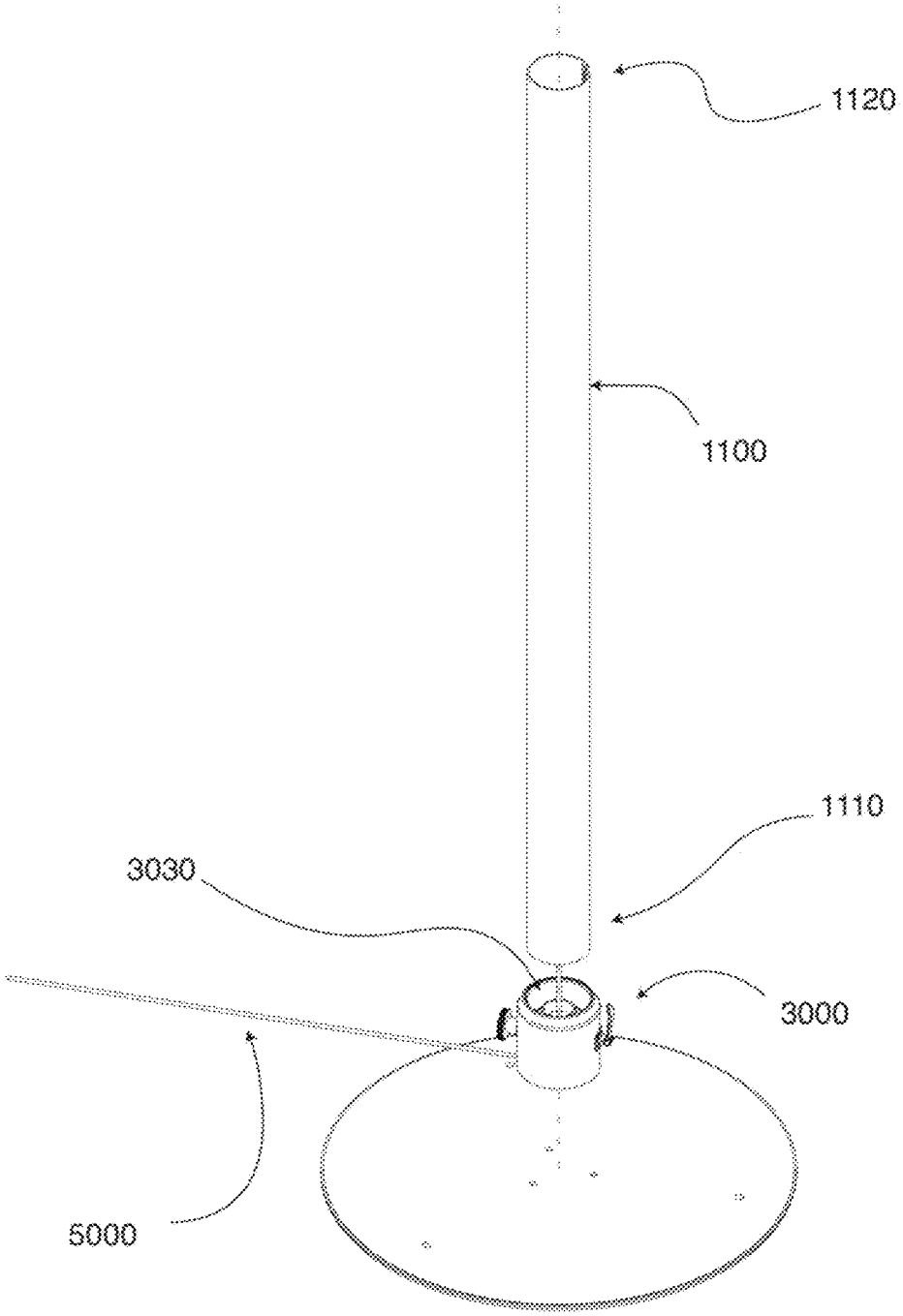
Figures 5A, 5B, 5C:
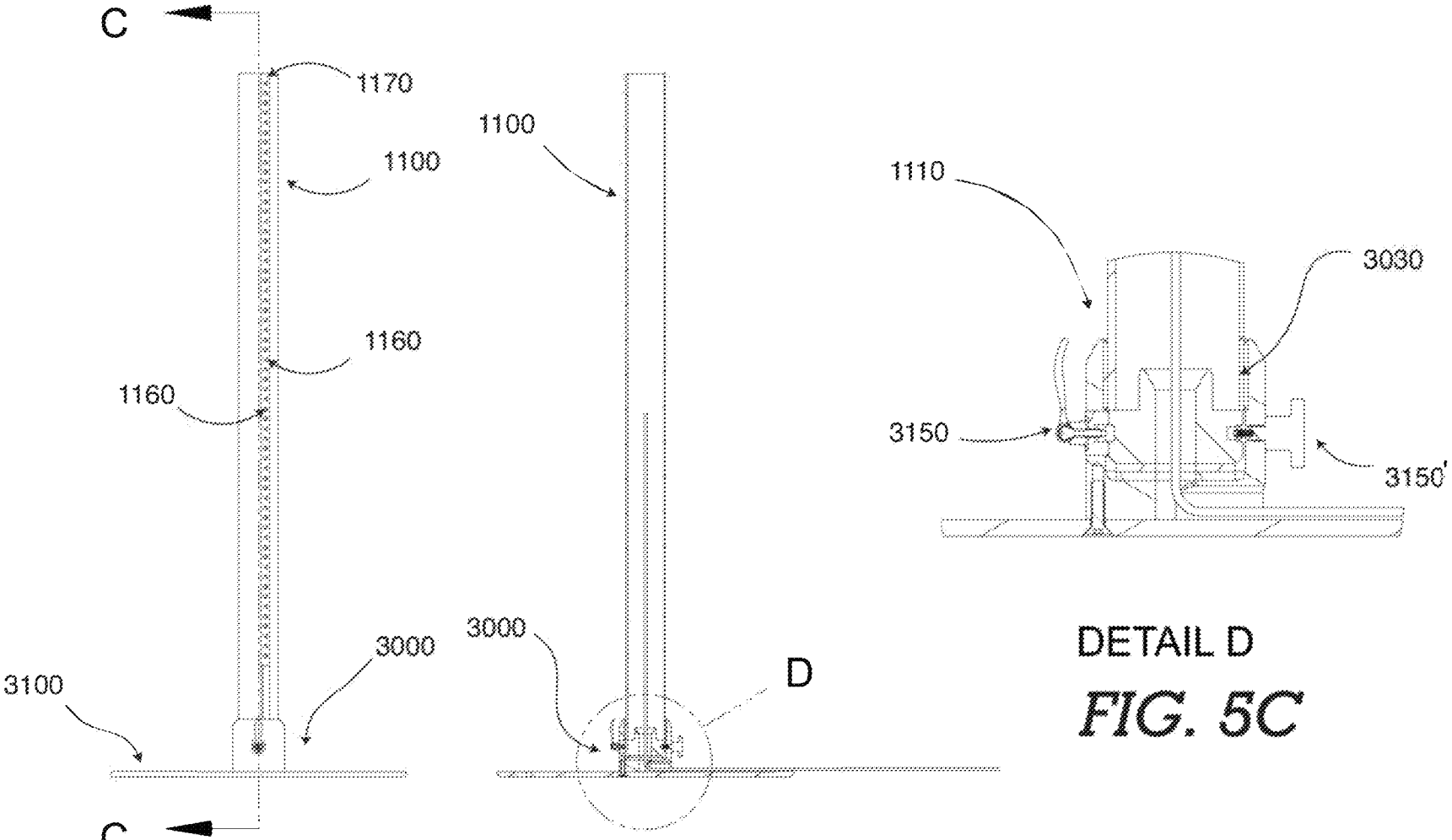

In some embodiments, as shown in FIG. 4-FIG. 5C for instance, a column receiver 3000 comprises a recess 3030 configured to receive the first end 1110 of the column therein. The column receiver 3000 of certain embodiments is configured to hold the column 1100 in an desired orientation. In some embodiments, the column receiver further comprises a column retention device 3150 for restricting the column axially and rotatively within the column receiver. In some embodiments, column retention device 3150' longitudinally restricts the longitudinal movement of the column 1100 within the column receiver 3000 (e.g., via a pin to engage with an annular groove in the column), while allowing the column to rotate independently of the column receiver. Embodiments wherein the column receiver and column are free-standing, and embodiments wherein the column receiver and column are affixed to an existing structure or ground surface 9000 are within the spirit and scope of the present disclosure. Furthermore, embodiments wherein the column is not in an upright or vertical configuration are within the spirit and scope of the present disclosure.

Figure 6A:
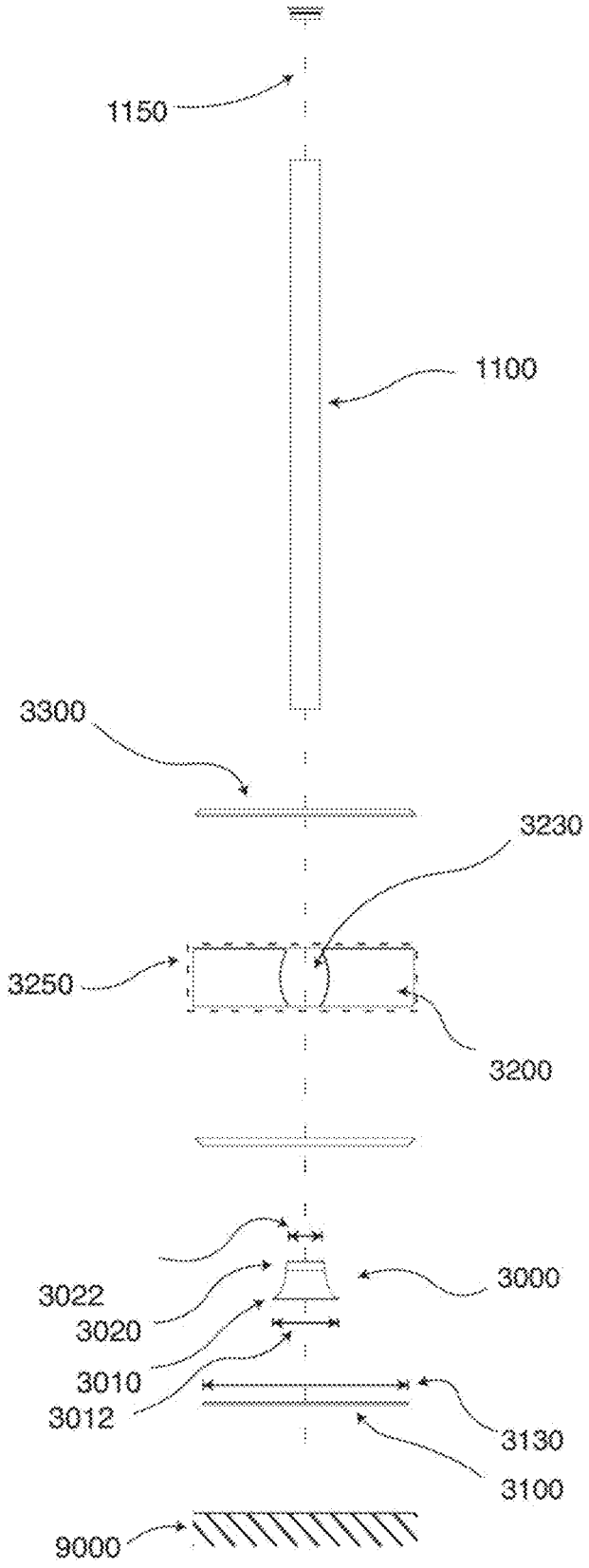
Figure 6B:
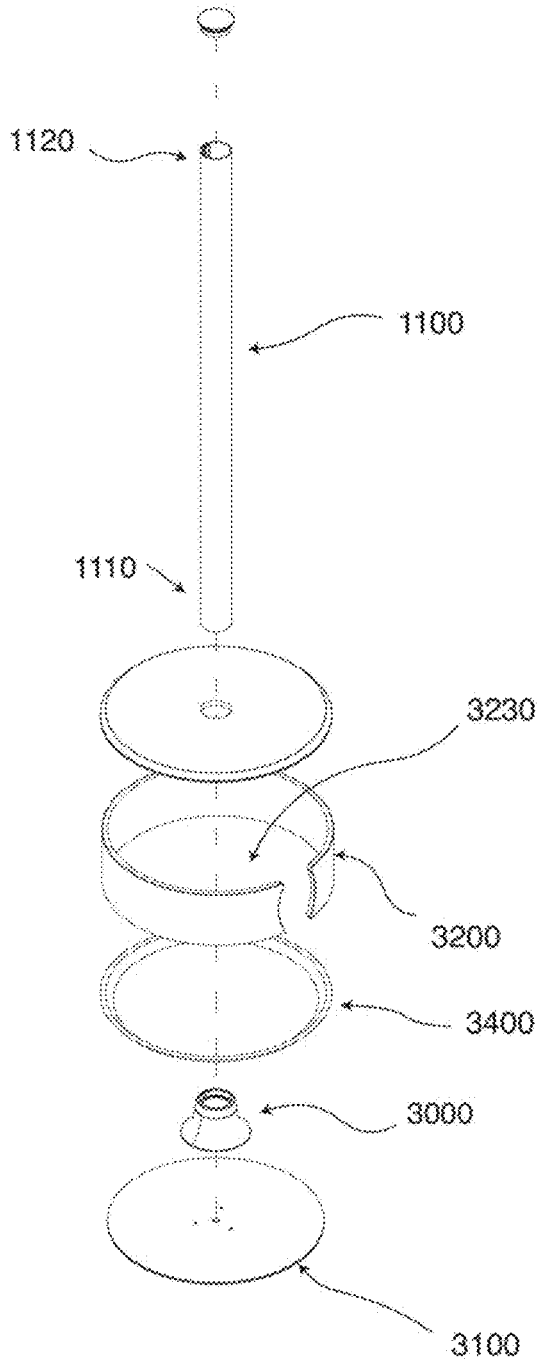

In some embodiments, shown in FIG. 6A-FIG. 6B for instance, the column receiver 3000 comprises a flared body wherein the diameter 3012 of the first end 3010, configured to rest on a ground surface, is greater than the diameter 3022 of the second end 3020 of the receiver. In some embodiments, the column receiver 3000 further comprises a base 3100 configured to be supported by a ground surface 9000 wherein the base 3100 comprises a diameter 3130 greater than the maximum diameter of the column receiver. In some embodiments the base 3100 comprises a diameter 3130 greater than the maximum diameter of the column receiver. In some embodiments the base diameter 3130 is greater than 5-times the maximum diameter of the column receiver.

Figure 6C:
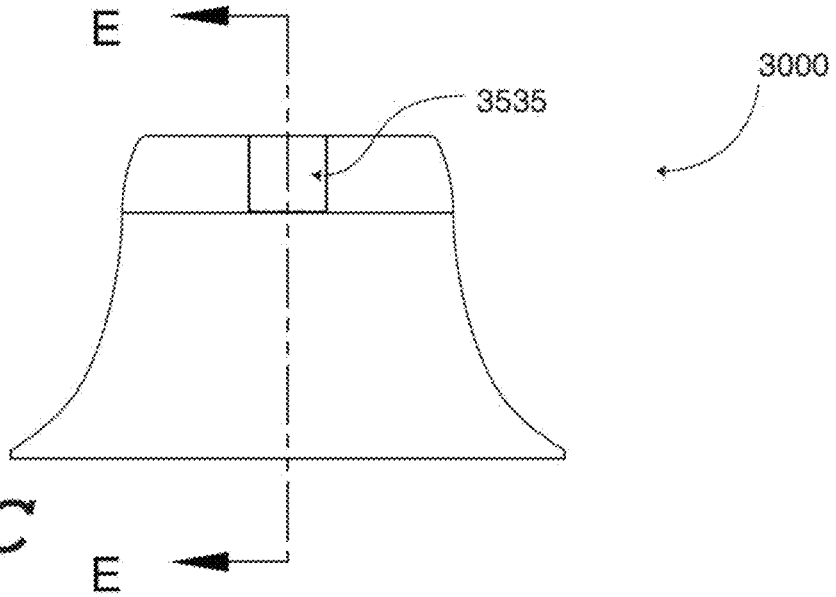
Figure 6D:
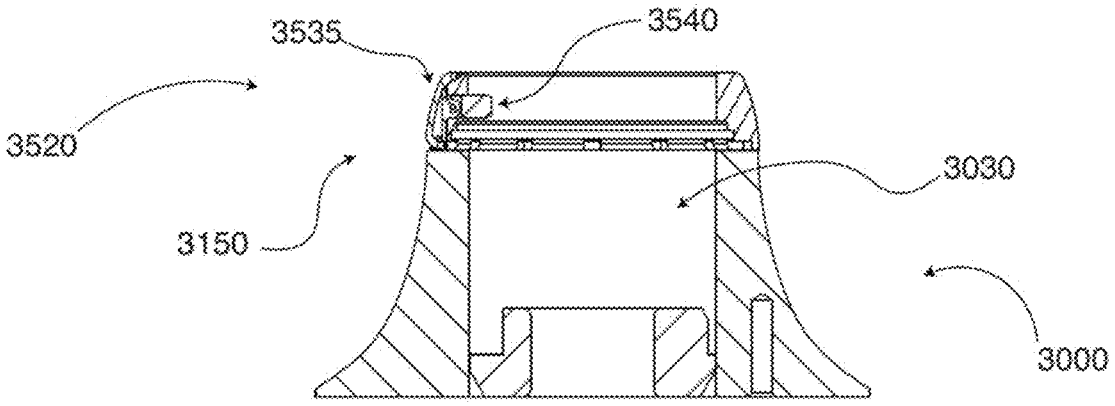
Figure 6E:
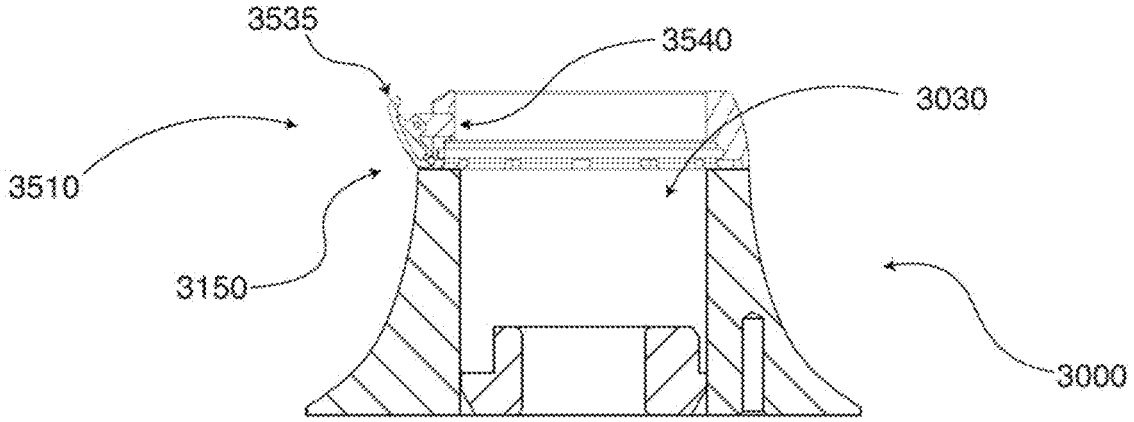

In some embodiments, as shown in FIG. 6C-FIG. 6E for instance, the column receiver 3000 comprises a column retention device 3150 comprising a lever actuated detent 3540. The lever 3535 is pivotally interconnected with the column receiver 3000, and the detent 3540 is pivotally interconnected with the lever 3535 of the column retention device. When the lever 3535 of the column retention device is pivotally rotated away from the column receiver 3000, the detent 3540 is withdrawn from the opening 3030 of the column receiver and thereby from an aperture 1160 of the column, thus placing the column retention device in an unlocked configuration 3510. The unlocked configuration 3510 of the column retention device 3150 allows the longitudinal adjustment of the receiver 3000 in relation to the column 1100. When the lever 3535 of the column lock is pivotally rotated toward the column receiver 3000, the detent 3540 is advanced forward into the opening 3030 of the column receiver wherein the detent 3540 can be aligned with and inserted into an aperture 1160 of the column, thereby placing the column retention device 3150 in a locked configuration 3520 and restricting the longitudinal movement of the column receiver 3000 in relation to the column 1100. In some embodiments, when the column retaining device is in a locked configuration, the column is able to rotate freely (e.g., unrestricted) about a longitudinal axis (1150 at FIG. 6A) while the longitudinal movement of the column receiver 3000, in relation to the column 1100, is restricted.

In some embodiments a base 3100 further comprises sidewalls 3200 interconnected thereto, wherein the sidewalls 3200 extend upward from the base 3100. The sidewalls 3200 define a volume 3250 bounded by the base 3100, the sidewalls 3200, and top edge 3220 of the sidewalls, wherein objects can be stored. In some embodiments the volume 3250 further comprises a lid 3300 which is configured to enclose the volume 3250 defined by the sidewalls 3200 and the base 3100. In some embodiments, the sidewalls 3200 comprise an aperture 3230 or gap wherethrough objects can be placed laterally into the volume 3250, or allow for an animal such as a household pet to enter or exit the volume 3250. In some embodiments the lid 3300 is slidably adjustable along the longitudinal axis 1150 of the column to provide or restrict top access or ventilation into the volume. While embodiments shown herein demonstrate the lid 3300 as separate from the base 3100, embodiments wherein the lid 3300 is affixed to the sidewalls 3200 are within the spirit and scope of the present disclosure.

Certain embodiments, shown in FIG. 6A-FIG. 6B for instance, comprise a light diffuser 3400. As shown, the light diffuser 3400 comprises an annular form configured to provide diffuse light when coupled with a light source. Alternative embodiments include an annular light diffuser 3400 coupled with the column within the volume, interconnected to the column at the first end 1110, interconnected to the column at the second end 1110, or interconnected with the column 1100 therebetween while in keeping with the spirit and scope of the present disclosure. Further embodiments comprising a light diffuser 3400 having alternate shapes including a linear or curvilinear form are within the spirit and scope of the present disclosure.

Figure 7A:
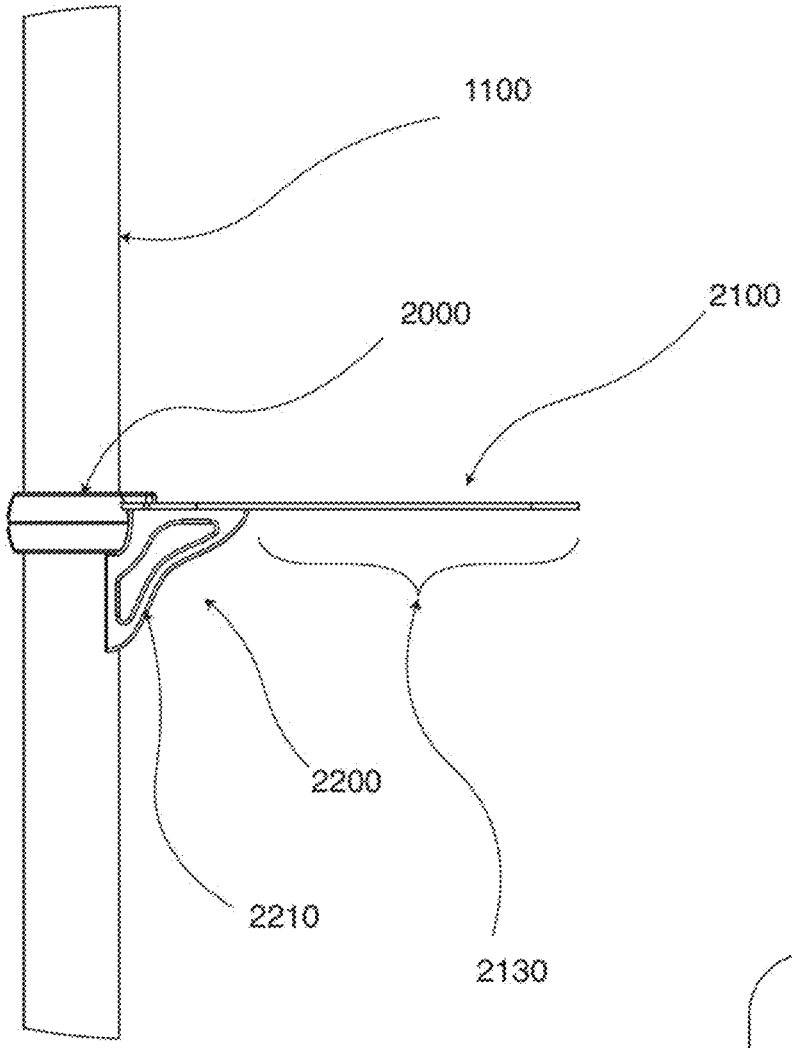
Figure 7B:
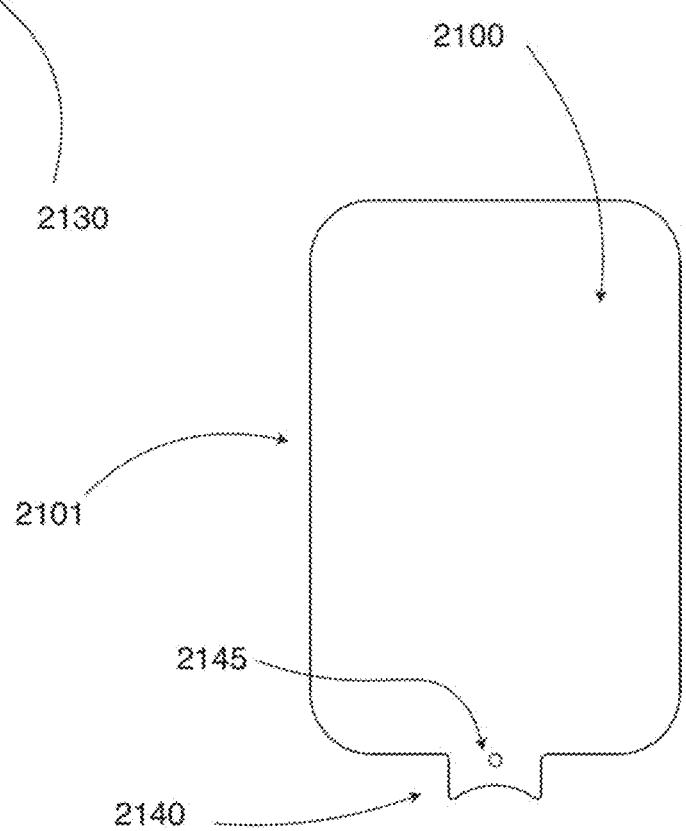
Figure 8A:
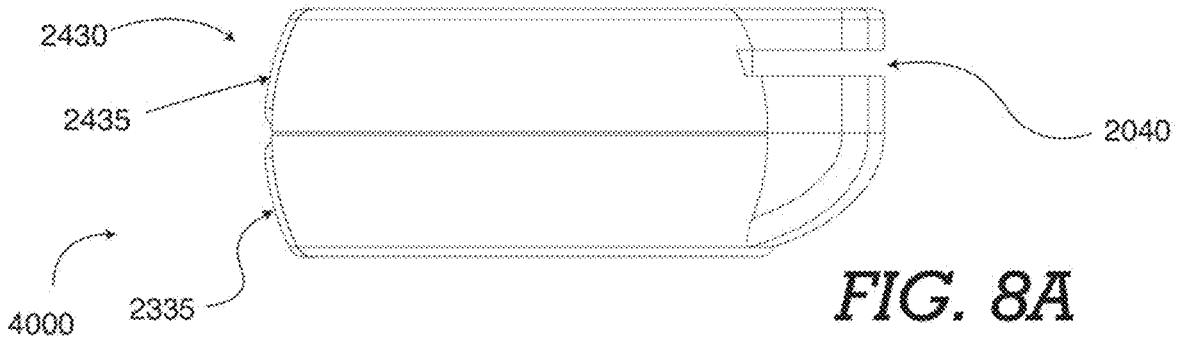
Figure 8B:
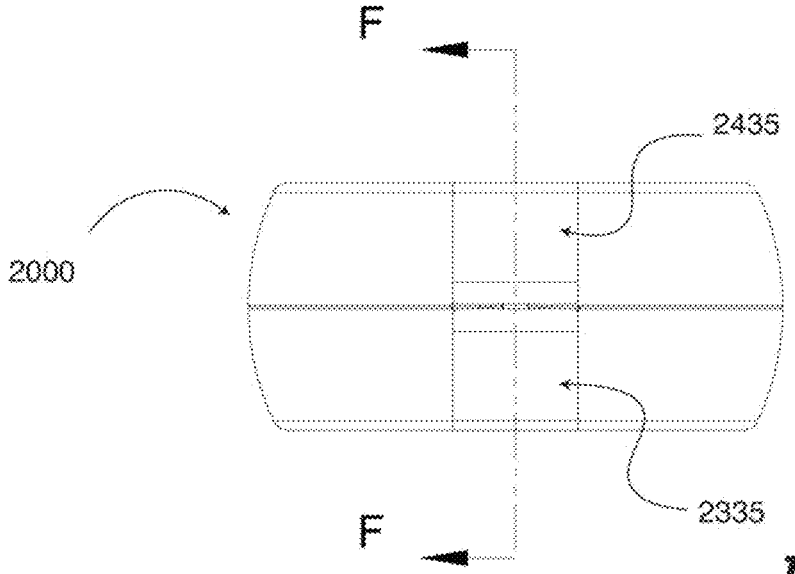
Figure 8C:
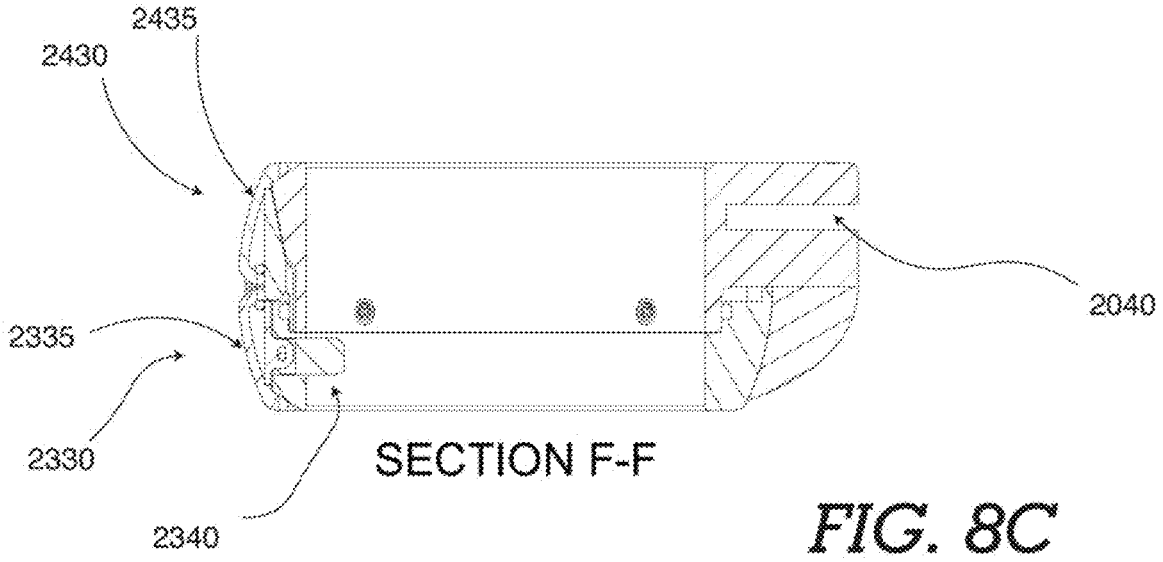
Figure 8D:
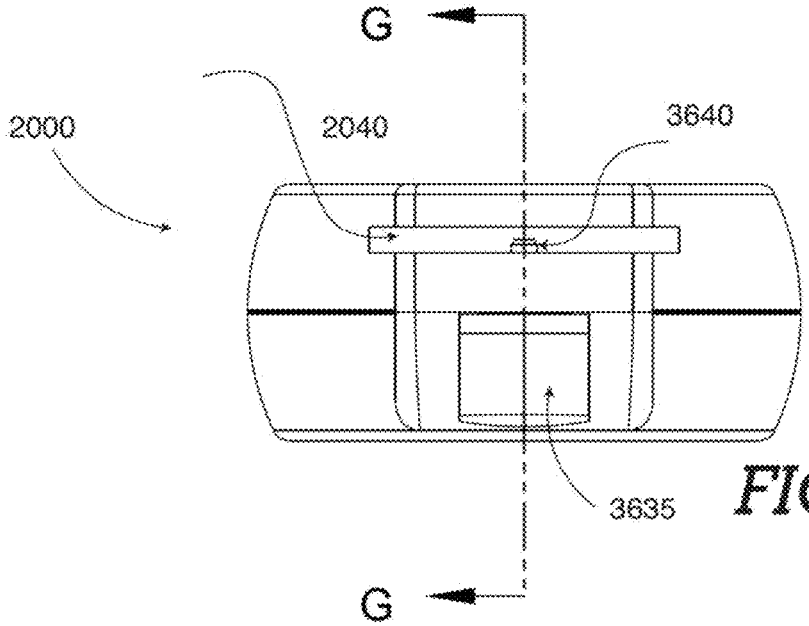
Figure 8E:
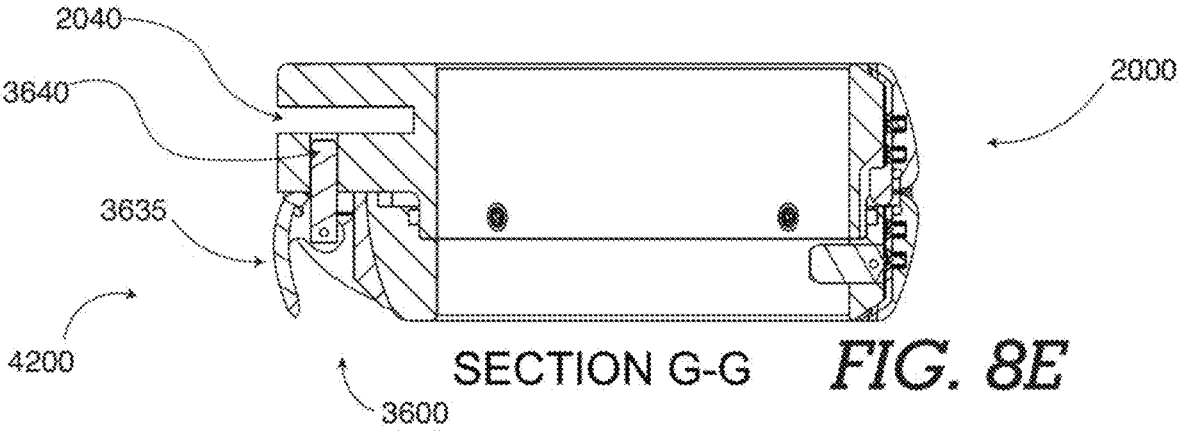
Figure 8F:
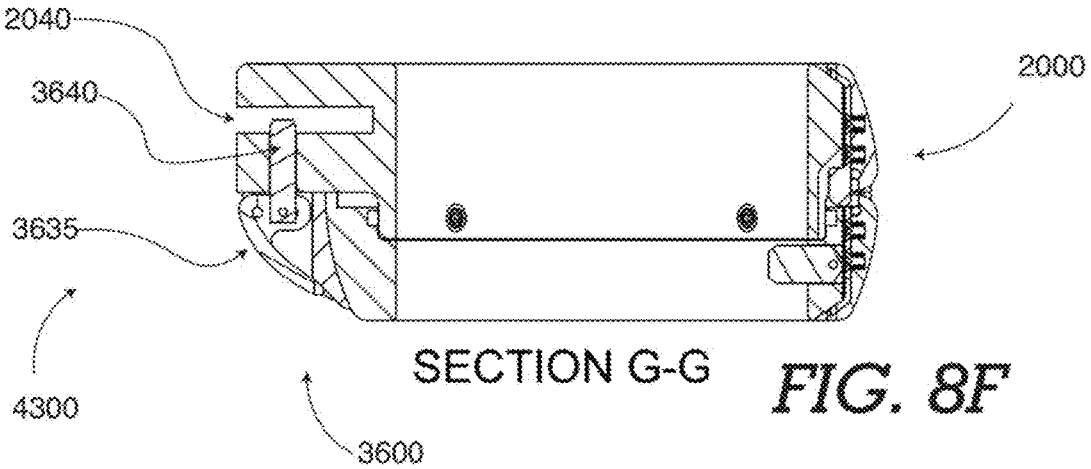

Certain embodiments, as shown in FIG. 7A-FIG. 7B for instance, comprise an accessory ring 2000 configured to interconnect with the column 1100 wherein the accessory ring comprises an opening 2030 configured to slidably receive the column 1100 therein. In some embodiments, the accessory ring 2000 is further configured to receive an object for interconnection to the column 1100 using the accessory ring.

In some embodiments, as shown in FIG. 7A-FIG. 8C for instance, an accessory ring 2000 is configured to receive a platform 2100 for interconnection with the column 1100. The accessory ring 2000 comprises a platform support 2200 which provides structural support for a platform 2100 having a cantilevered portion 2130. In some embodiments the accessory ring 2000 comprises a slot 2040 wherein a sheetmaterial can be inserted therein to interconnect with the accessory ring 2000 to provide a platform interconnected with the column 1100. In some embodiments a platform 2100 comprises a sheet form comprising a tab 2140 configured to be received by a slot 2040 of the accessory ring. The platform 2100 is interconnected to the accessory ring 2000 by inserting the tab 2140 of the platform into the slot 2040 of the accessory ring. While embodiments shown herein comprise a tab and slot connection strategy between the platform 2100 and the accessory ring 2000, embodiments comprising alternate methods of interconnecting the platform 2100 to the accessory ring 2000 are within the spirit and scope of the present disclosure. Alternate methods of interconnecting the platform to the accessory ring include, but are not limited to, mechanical fasteners, adhesive, welding, or other known interconnection methods.

In some embodiments, such as shown in FIG. 7A for instance, a support 2200 is interconnected to the accessory ring and platform to bolster an accessory, such as a platform 2100 which is cantilevered away from the accessory ring. In some embodiments the support 2200 comprises a gusset 2210 which can be interconnected to the accessory ring 2000, interconnected to the platform 2100, interconnected to the column 1100, or a combination thereof while in keeping with the spirit and scope of the present disclosure. Alternative embodiments using a support 2200 to bolster other accessories, such as—but not limited to—a scale, lighting, sensor, sensor array, cameras, surveillance equipment, signage, camera mount, lighting mount, solar panels, hook, RFID reader, plants, speakers, a projector, a pet treat dispenser, a display, a point of sale display, a kiosk, ornaments, storage accessories, or a book holder are within the spirit and scope of the present disclosure.

In some embodiments, as shown in FIG. 7B and FIG. 8D-FIG. 8F for instance, the accessory ring 2000 comprises an accessory lock 3600 wherein an accessory 2101, such as a platform 2100, is locked in place with a lever actuated locking mechanism. The accessory lock 3600 comprises a lever 3635 which is pivotally interconnected with the accessory ring 2000, and a detent 3640 which is pivotally interconnected with the accessory ring. When the lever 3635 of the accessory lock is pivotally rotated away from the accessory ring 2000, the detent 3640 is withdrawn from the slot 2040, and thereby withdrawn from an aperture 2145 of the accessory 2101. The rotation of the lever 3635 away from the accessory ring 2000 results in the accessory lock 3600 being placed in an unlocked configuration 4200. When the lever 3635 of the accessory lock 3600 is rotated toward the accessory ring 2000, the detent is advanced through the slot 2040 of the accessory ring and through an aperture 2145 of the accessory thus constraining the accessory 2101 to the accessory ring 2000. The rotation of the lever 3635 away from the accessory ring results in the accessory lock 3600 being placed in a locked configuration 4300. While embodiments of the accessory lock 3600 discussed herein rely on a lever actuated detent, alternate forms of an accessory lock 3600 which allow a user to alternatingly lock or unlock an accessory 2101 to an accessory ring 2000 are within the spirit and scope of the present disclosure. Embodiments comprising a friction lock, a pin-lock (as shown herein), a screw lock, or other locking strategies are within the spirit and scope of the present disclosure.

Figure 9A:
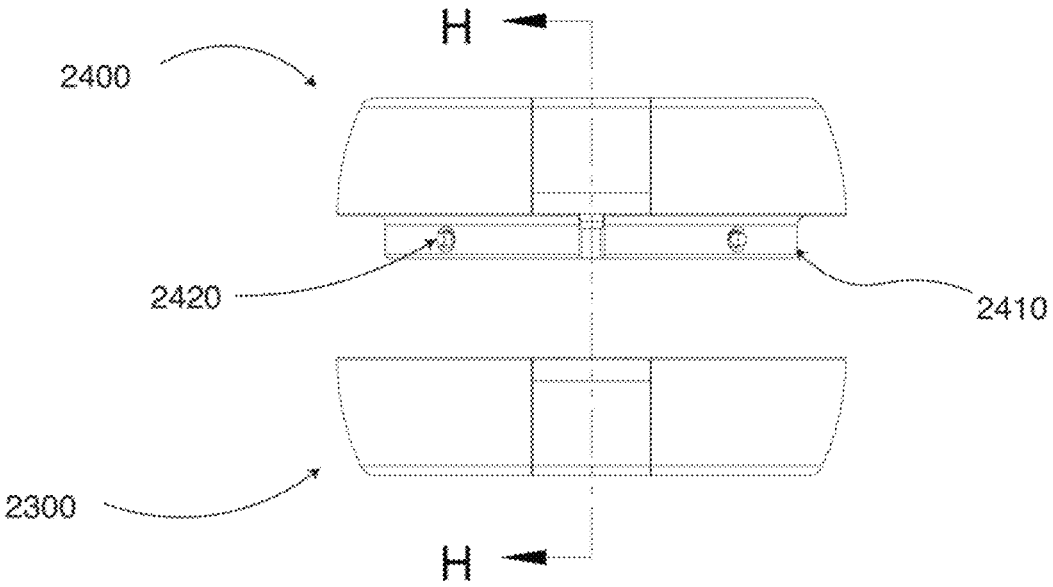
Figure 9B:
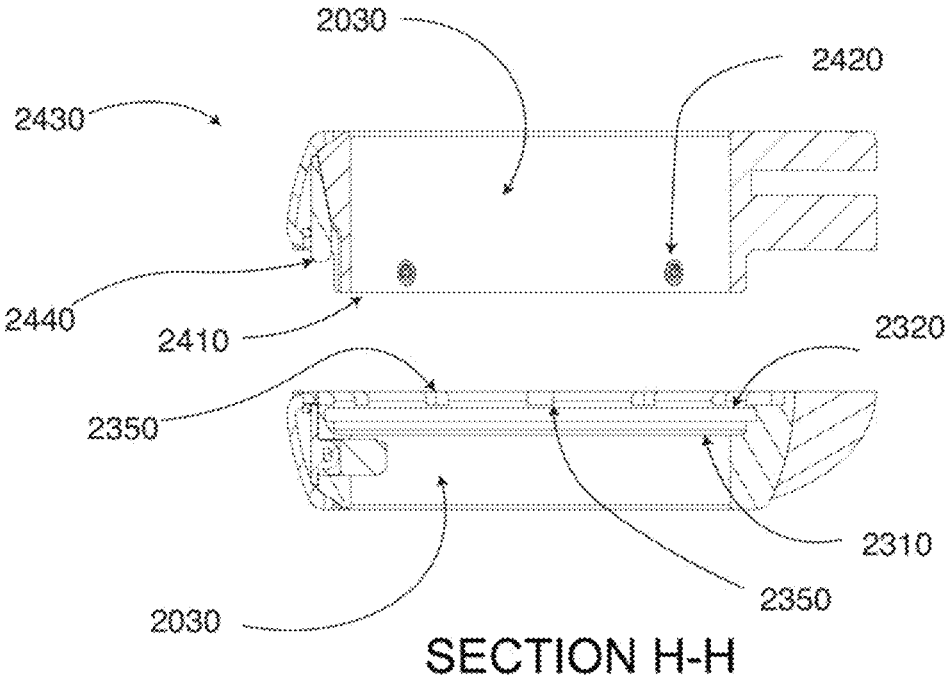
Figure 10A:
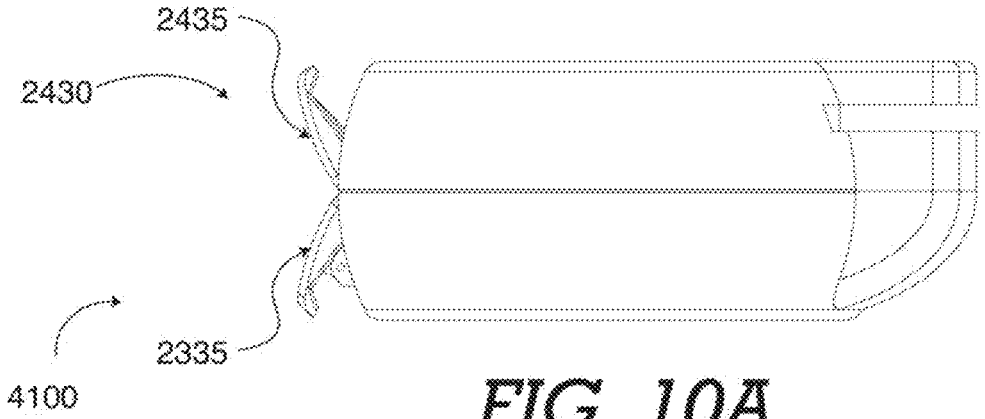
Figure 10B:
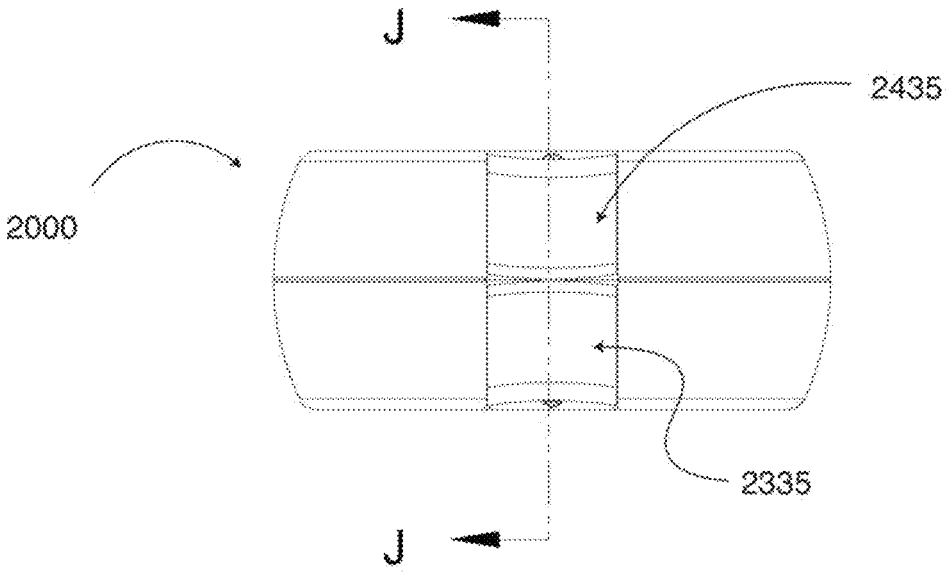
Figure 10C:
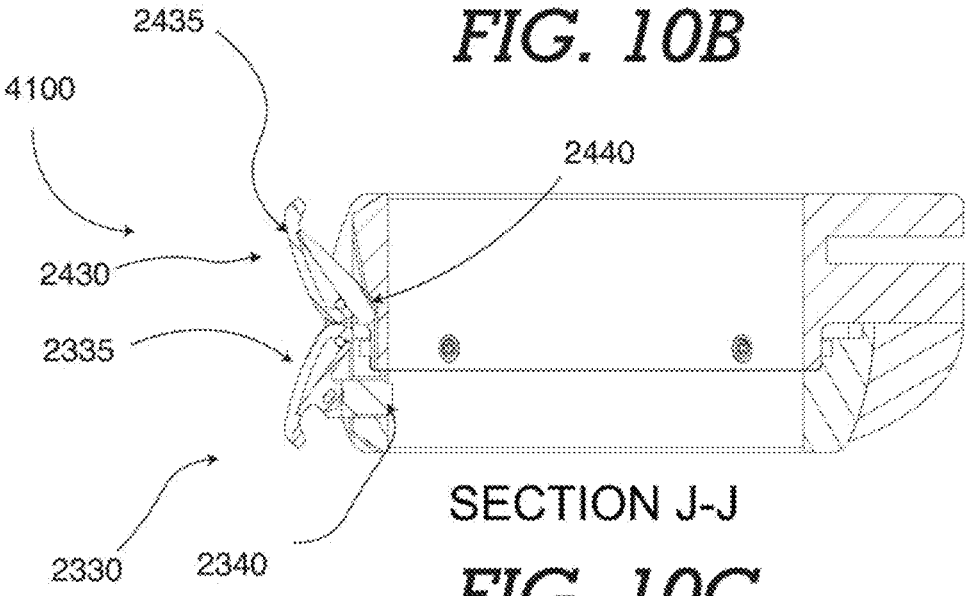
Figure 11C:
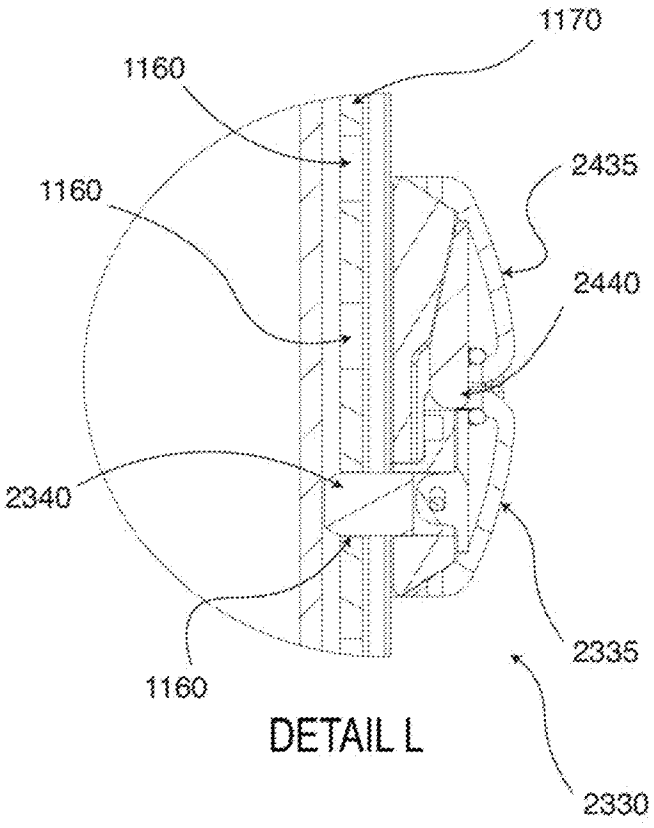
Figure 11B:
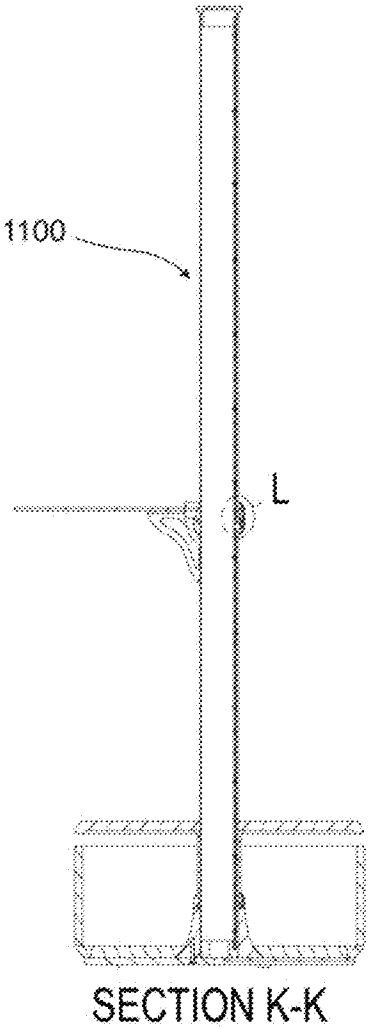
Figure 11A:
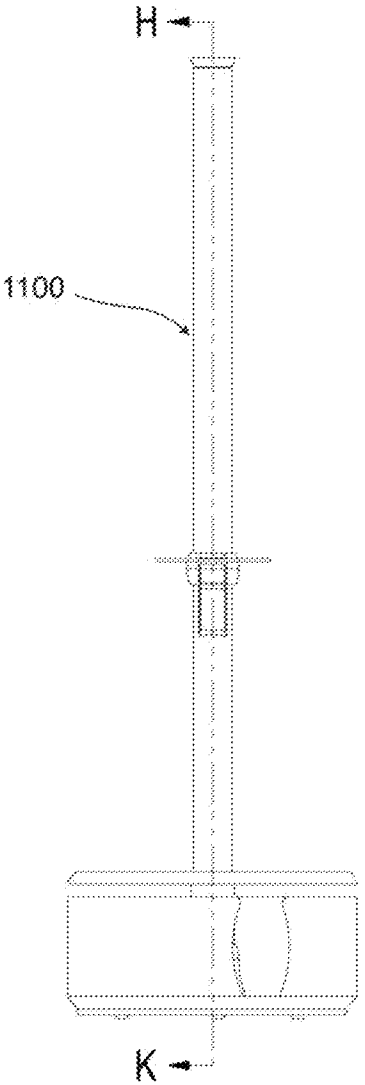
Figure 12A:
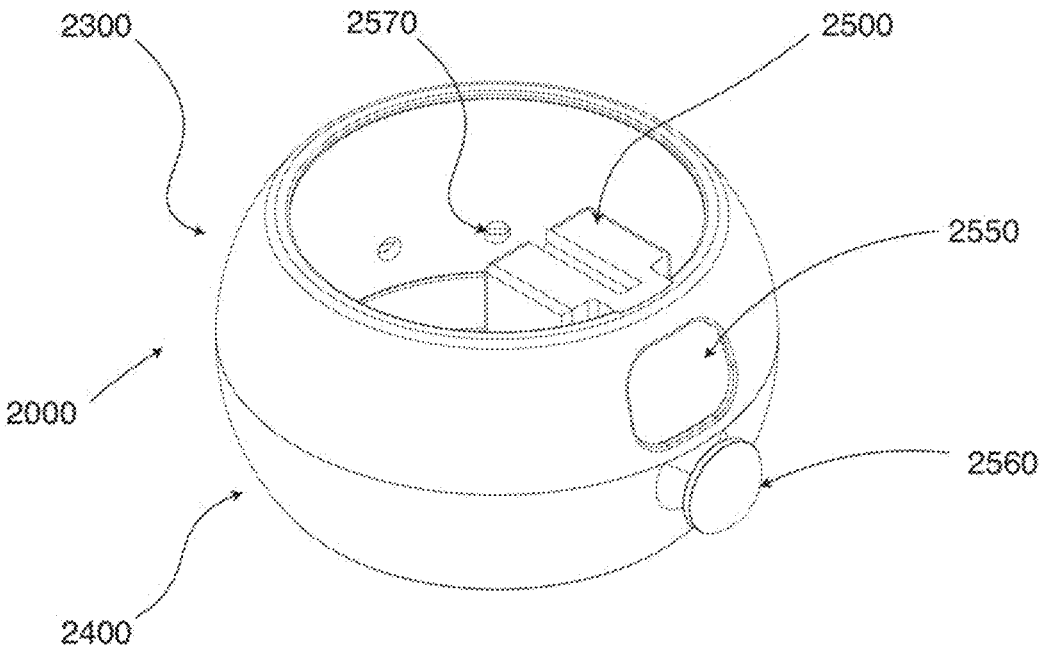
Figure 12B:
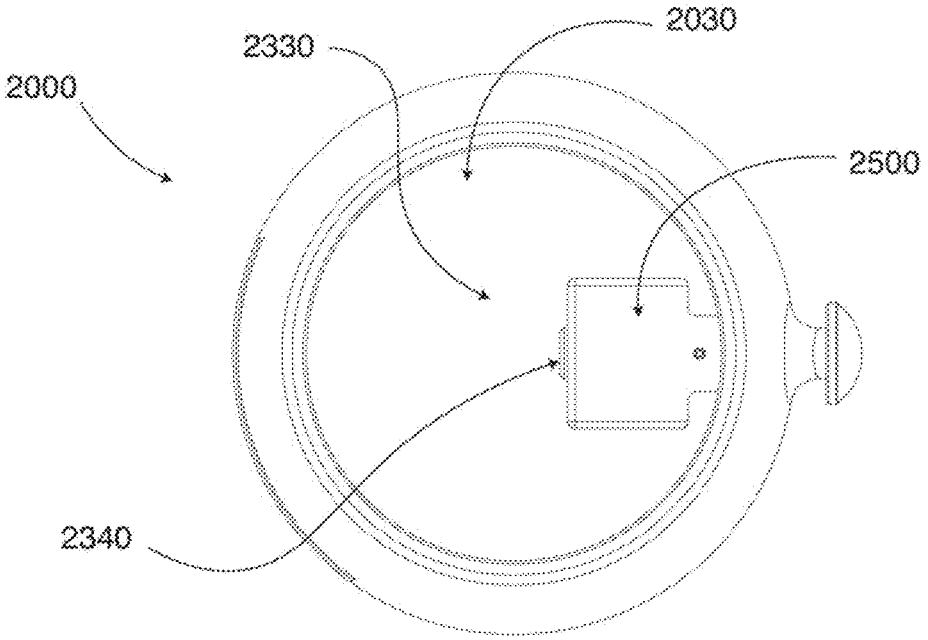
Figure 13A:
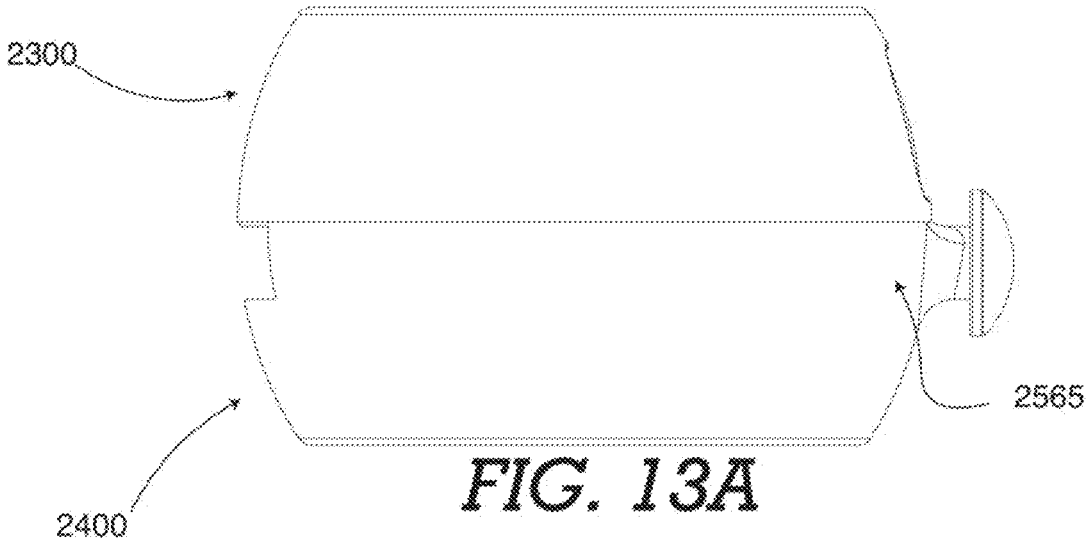
Figure 13B:
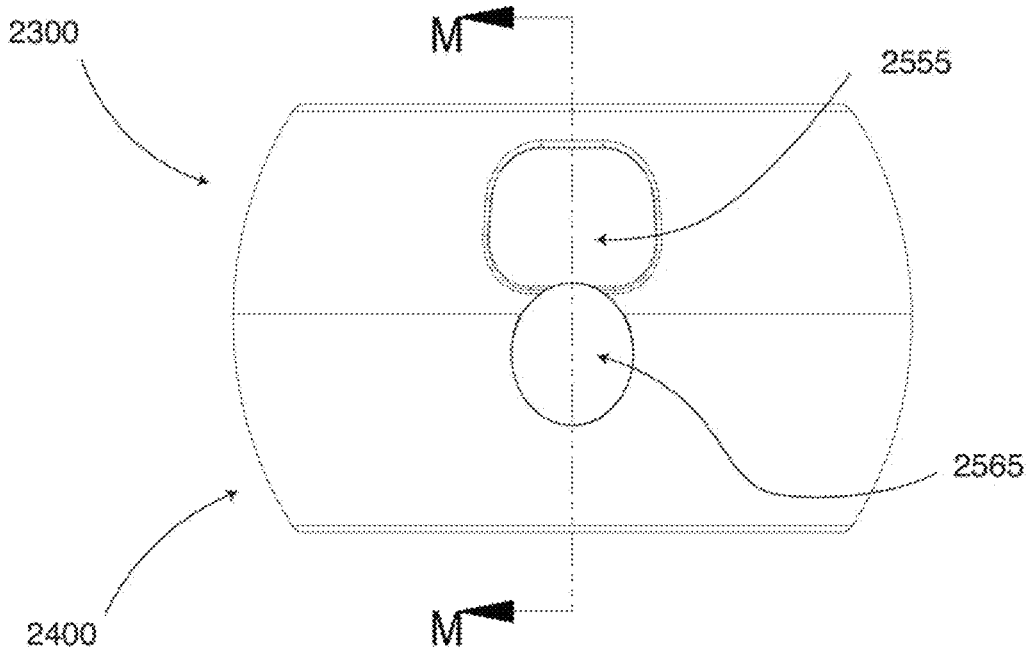
Figure 13C:
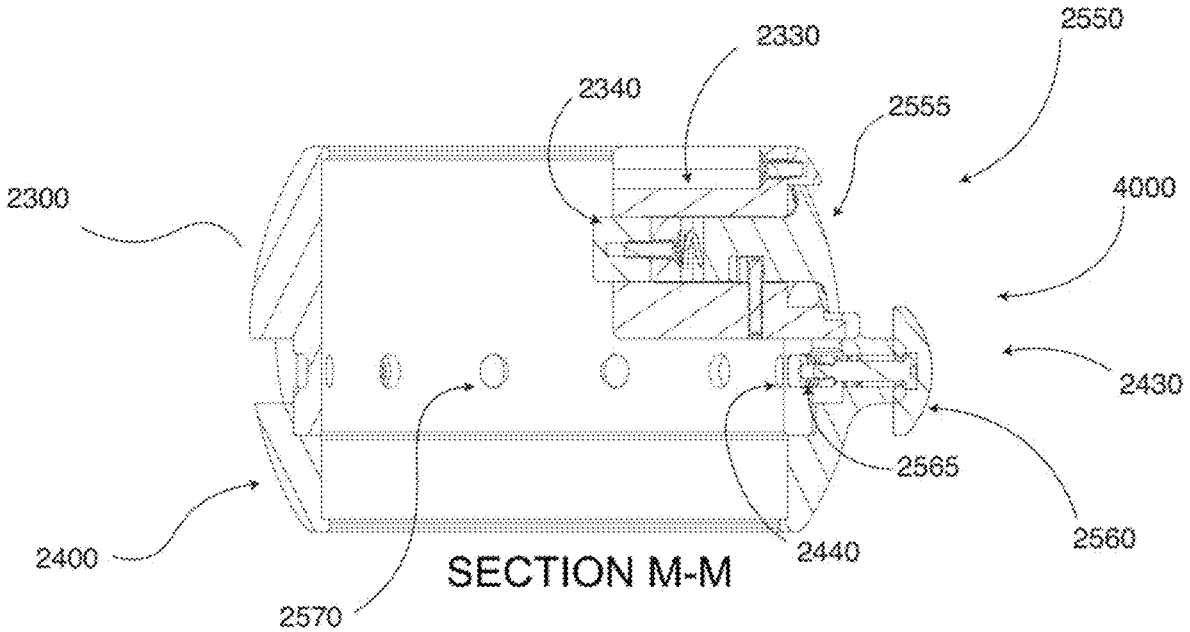
Figure 13D:
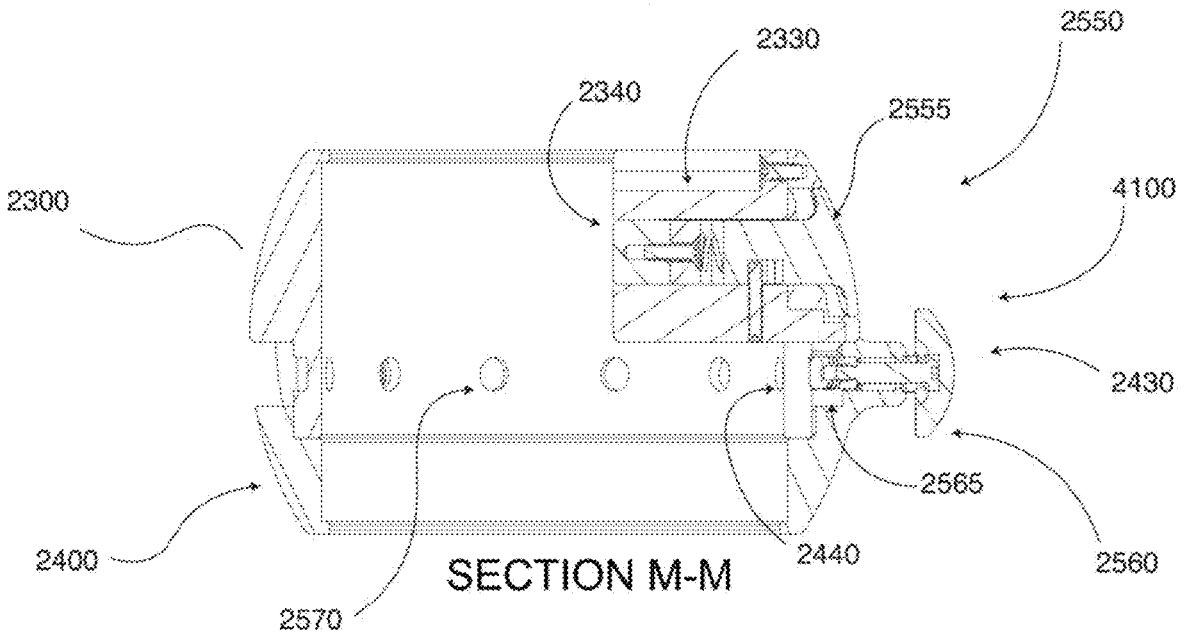

In some embodiments, as shown in FIG. 9A-FIG. 9B for instance, the accessory ring 2000 comprises a first aspect 2300 and a second aspect 2400 wherein each aspect comprises an annulus, with an opening 2030 therethrough configured to receive the outer profile 1130 of the column. In some embodiments the second aspect 2400 of the accessory ring is configured to nest with the first aspect 2030 of the accessory ring, wherein a collar 2410 of the second aspect of the accessory ring is configured to be received by an annular recess 2310 of the first aspect of the accessory ring. The nesting of the aspects of the accessory ring is intended to maintain the first aspect of the accessory ring as coaxial with the second aspect of the accessory ring. In some embodiments the first aspect 2300 of the accessory ring is configured to nest with the second aspect 2400 of the accessory ring, wherein at least one set-screw 2420 constrains the first aspect 2300 with the second aspect 2400. In some embodiments as shown, following the nesting of the first aspect 2300 with the second aspect 2400, at least one set-screw 2420 is advanced between the first aspect 2300 and second aspect 2400. As shown, the set-screws 2420 are advanced from the second aspect 2400, and into an annular groove 2320 of the first aspect. Thus, the first aspect 2300 and second aspect 2400 are permitted to rotate coaxially in relation to each other, but are constrained from separating longitudinally. Although embodiments shown herein comprise an accessory ring 2000 comprising a first annular aspect 2300 and a second annular aspect 2400, embodiments comprising a unitary accessory ring are within the spirit and scope of the present disclosure.

In some embodiments, as shown in FIG. 5A and FIG. 8A-FIG. 11C, the first aspect 2300 of the accessory ring comprises a column lock 2330 configured to restrict the accessory ring 2000 longitudinally along the column 1100 when the column lock 2330 is in a locked configuration 4000. In an unlocked configuration 4100, the column lock 2330 allows the longitudinal adjustment of the accessory ring along the column. In some embodiments the column lock 2330 comprises a detent 2340. In some embodiments as shown, the detent 2340 of the column lock comprises a pin, wherein the pin is configured to insert into an aperture 1160 on the column in a locked configuration. In some embodiments the column comprises a plurality of apertures 1160 wherein the detent 2340 of the column lock is configured to insert into any one of the plurality of apertures 1160. Thus, the accessory ring 2000 can be constrained in a plurality of distances from the first end 1110 of the column. In some embodiments the column 1100 comprises a plurality of apertures 1160 spaced equally longitudinally along the column. In some embodiments, the column lock comprises a friction lock (e.g., friction plate, friction ring, etc.) between the accessory ring and the column, wherein placing the column lock in a locked configuration increases the friction between the column and the friction element, thereby restricting the longitudinal adjustment of the accessory ring along the column. Additionally or alternatively, placing the column lock in an unlocked configuration results in decreasing the friction between the column and the friction element, thereby increasing the slidable adjustability of the accessory ring along the column.

In some embodiments the column comprises a channel 1170 (FIG. 2B) with apertures disposed therein. In some embodiments a plate 1170 (FIG. 5A & FIG. 11C) comprising a plurality of apertures 1160 therethrough is affixed within the channel 1170 longitudinally along the column to provide apertures for the column lock 2330 to interconnect with.

While embodiments shown comprise a plurality of apertures 1160 in a linear array longitudinally along the column, embodiments wherein the apertures 1160 are non-linearly arranged, and embodiments wherein the apertures 1160 are not equally spaced, are within the spirit and scope of the present disclosure. Furthermore, embodiments comprising a column lock 2330 having alternate restriction systems such as a detent, ratchet and pawl, rack and pinion, worm gear, magnetic detents, friction lock, brake, or other mechanical methods of arresting or resisting movement, are within the spirit and scope of the present disclosure.

In some embodiments, as shown in FIG. 8A-FIG. 11C, the column lock 2330 comprises a lever actuated detent. A lever 2335 is pivotally interconnected with the first aspect 2300 of the accessory ring, and the detent 2340 is pivotally interconnected with the lever 2335 of the column lock. When the lever 2335 of the column lock pivotally rotated away from the accessory ring 2000, the detent 2340 is withdrawn from the opening 2030 of the accessory ring and thereby from an aperture 1160 of the column, thus placing the column lock 2330 in an unlocked configuration 4100. The unlocked configuration 4100 of the column lock 2300 allows the longitudinal adjustment of the accessory ring 2000 along the column 1100. When the lever 2335 of the column lock is pivotally rotated toward the accessory ring 2000, the detent 2340 is advanced forward into the opening 2030 of the accessory ring wherein the detent 2340 can be aligned with and inserted into an aperture 1160 of the column, thereby placing the column lock 2330 in a locked configuration 4000 and restricting the longitudinal movement of the accessory ring 2000 along the column 1100.

In some embodiments, as shown in FIG. 8A-FIG. 11C for instance, a portion of the accessory ring 2000 is configured to rotate about a longitudinal axis 1150 (FIG. 5A) of the column. In some embodiments, the second aspect 2400 of the accessory ring is configured to rotate about a longitudinal axis 1150 of the column independent of the first aspect 2300 of the accessory ring. In some embodiments the second aspect 2400 of the accessory ring comprises a rotation lock 2430. Placing the rotation lock in a locked position 4000 constrains the second aspect 2400 of the accessory ring from rotating about the longitudinal axis 1150 of the column, and wherein placing the rotation lock 2430 in an unlocked configuration 4100 allows the second aspect 2400 of the accessory ring to rotate about the longitudinal axis 1150 of the column. In some embodiments a rotation lock 2430 is configured to constrain the rotation of the second aspect 2400 of the accessory ring in relation to the first aspect 2300 of the accessory ring. Furthermore, in some embodiments the rotation lock 2430 is configured to constrain the rotation of the second aspect 2400 of the accessory ring in relation to the column 1100.

In some embodiments, as shown in FIG. 8A-FIG. 11C for instance, the rotation lock comprises a detent 2440 configured to insert into a notch 2350 on the first aspect of the accessory ring. When the detent 2440 is inserted within a notch 2350 of the first aspect of the accessory ring, the second aspect 2400 is prevented from rotating in relation to the first aspect 2300 of the accessory ring. Embodiments shown herein comprise notches 2350 in the first aspect of the accessory ring configured to receive the detent 2440 of the rotation lock to constrain the second aspect 2400 of the accessory ring rotatively in relation to the first aspect 2300 of the accessory ring. However, embodiments comprising notches in the column configured to receive the detent 2440 of the rotation lock and constrain the second aspect 2400 of the accessory ring rotatively in relation to the column 1100 are within the spirit and scope of the present disclosure.

In some embodiments, the rotation lock comprises a lever 2435 actuated detent. The lever 2435 is pivotally interconnected with the second aspect 2400 of the accessory ring, and the detent 2440 is interconnected with the lever 2435 of the rotation lock. When the lever 2435 is pivotally rotated away from the body of the accessory ring, the detent 2440 is withdrawn from a notch 2350, thus placing the rotation lock 2430 in an unlocked configuration 4100 allowing the rotative adjustment of the accessory ring 2000 around the column. When the lever 2435 of the rotation lock is pivotally rotated toward the accessory ring 2000, the detent 2440 is advanced toward the first aspect 2300 of the accessory ring wherein the detent 2435 can be aligned with and inserted into a notch 2350, thus placing the rotation lock 2430 in a locked configuration 4000 and restricting the accessory ring 2000 from rotational adjustment about the column 1100.

In some embodiments, as shown in FIG. 9B for instance, the first aspect of the accessory ring 2300 comprises a plurality of notches 2350 configured to receive the detent 2440 of the rotation lock, wherein the second aspect 2400 of the accessory ring can be locked into a plurality of preset angular positions. In some embodiments the plurality of notches 2350 are placed at equal angular intervals. Although embodiments shown herein surround a rotation lock comprising a detent and notch engagement system, alternate embodiments comprising engagement systems such as a ratchet and pawl, rack and pinion, worm gear, magnetic detents, friction lock, brake, or other mechanical methods of arresting or resisting movement are within the spirit and scope of the present disclosure.

In some embodiments, shown for instance in FIG. 2A-FIG. 2D and FIG. 12A-FIG. 12B, the accessory ring 2000 comprises a column lock 2330 configured to slidably interface with a channel 1170 of the column. In some embodiments the column 1100 comprises a plurality of channels 1170 wherein the channels are radially spaced around the external surface 1105 of the column, and each channel is configured to have a locking mechanism interconnected therewith.

In some embodiments, shown in FIG. 11A-FIG. 13D for instance, the accessory ring 2000 comprises a keyed element 2500 configured to be slidably received by a channel 1170 (FIG. 2D) of the column 1100, wherein the channel comprises a t-slot or similar keyed profile wherein the keyed element 2500 is configured to be slidably inserted within the channel 1170. In some embodiments, the keyed element 2500 extends radially inward from a first aspect 2300 of the accessory ring and into the opening 2030 of the accessory ring. The keyed element 2500 further comprises a column lock 2330. The column lock 2330 comprises a detent 2340 configured to extend radially through the keyed element 2500 and into the opening 2030 of the accessory ring, wherein the detent 2340 is configured to interconnect with apertures 1160 in the column. When the detent 2340 is extended inward and into an aperture 1160 of the column, the column lock 2330 is placed in a locked configuration 4000, thereby constraining the accessory ring 2000 from moving longitudinally along the column 1100. When the detent 2340 is withdrawn from the aperture 1160 of the column thereby placing the column lock 2330 in an unlocked configuration 4100, the accessory ring 2000 is permitted to move longitudinally along the column 1100. In some embodiments the column lock 2330 comprises a push-button release mechanism 2550 wherein a push-and-release (e.g., depressing and subsequently releasing) a button 2555 alternatingly toggles the column lock 2330 between a locked configuration 4000, and an unlocked configuration 4100. Additionally or alternatively, in some embodiments the interface between the accessory ring and the column, and/or between the accessory ring and an accessory, includes one or more of a Video Electronics Standard Association (VESA) mount, T-slot, bayonet, and/or dovetail.

In some embodiments, shown in FIG. 11A-FIG. 13C for instance, the accessory ring 2000 further comprises a second aspect 2400 comprising a rotation lock 2430. The rotation lock 2430 is configured to restrict the rotation of the second aspect 2400 of the accessory ring in relation to the first aspect 2300 of the accessory ring when the rotation lock 2430 is in a locked configuration 4000. The rotation lock comprises a detent 2440 configured to insert into an aperture 2570 of the first aspect of the accessory ring. When the detent 2440 of the rotation lock is inserted through an aperture 2570 of the first aspect, the second aspect 2400 of the accessory ring is constrained from rotation in relation to the first aspect 2300 of the accessory ring. In some embodiments, the rotation lock 2430 comprises a spring-loaded knob 2560 wherein pulling (e.g., with a force to overcome the force applied by a spring 2565) the knob 2560 radially away from the accessory ring withdraws the detent 2440 from an aperture 2570 of the second aspect of the accessory ring, thereby placing the rotation lock 2430 in an unlocked configuration 4100 and allowing the second aspect 2400 of the accessory ring to rotate in relation to the first aspect 2300 of the accessory ring. When the knob 2560 is released, a spring 2565 actuates the detent inward 2440, and when the detent 2440 is aligned with an aperture 2570 in the first aspect of the accessory ring, the detent 2440 inserts into the aperture 2570 of the first aspect of the accessory ring thereby placing the rotation lock 2430 in a locked configuration 4000 and restricting the second aspect 2400 from rotating in relation to the first aspect 2300. Without a force applied (e.g., via pulling the spring-loaded knob radially outward) to overcome the inward force applied by the spring, the rotation lock is configured in the locked configuration by default.

In some embodiments, as shown in FIG. 4 and FIG. 7A for instance, the column receiver comprises an electrical power source 5000. The electrical power source 5000 of certain embodiments comprises a battery, while embodiments comprising an electrical connection to an AC or DC power source are within the spirit and scope of the present disclosure. In some examples, referencing FIG. 6A-6B for example, a power source comprises a battery interconnected and/or integrated with a base 3100 (at FIG. 6A-6B), column receiver 3000, column 1100, accessory ring 2000 (at FIG. 7A), and/or accessory (e.g., platform 2100 at FIG. 7A). In some examples, electrical interconnectivity between elements results in elements without a power source receiving electrical power when interconnected with an element comprising a power source. Furthermore, in some examples, when elements are interconnected (e.g., a column to a column receiver, and/or accessory ring to a column) the interconnected elements comprise digital communication between the digital elements. For instance, interconnecting an accessory ring with a column, and a column to a column receiver, optionally results in the accessory ring being in digital communication with the column receiver and/or other accessory rings interconnected with the column. Further embodiments comprising a solar panel, such as a photovoltaic panel, allow for the transmission of power from the panel to grid power or other accessories interconnected with the column. In some embodiments, the electrical power source 5000 of the column receiver is configured to provide electrical power to the column 1100 when the column is interconnected with the column receiver 3000. Furthermore, in some embodiments wherein the columnar mounting system 1000 has electric power, the interconnection of a column receiver 3000 connects to the electrical power of the column 1100 to provide electrical power through the accessory ring 2000 and to an accessory such as a platform 2100 scale, lighting, sensor, sensor array, cameras, audio visual equipment or surveillance equipment, signage, or other requiring power.

In some embodiments, the column receiver comprises wired or wireless communication protocols such as Bluetooth®, Zigbee®, WiFi®, or wired network communication protocols. In some embodiments, communication protocol connectivity is provided to the column when the column is interconnected with the column receiver. In some embodiments still, when an accessory ring is interconnected with the column, the communication protocol connectivity is provided to the accessory ring. Furthermore, when an accessory is interconnected with the accessory ring, the communication protocol connectivity is provided to the accessory. Accessories configured to receive communication protocol connectivity include, but are not limited to: a scale, lighting, sensor, sensor array, cameras or surveillance equipment, signage, or other accessory requiring power.

Figure 1:
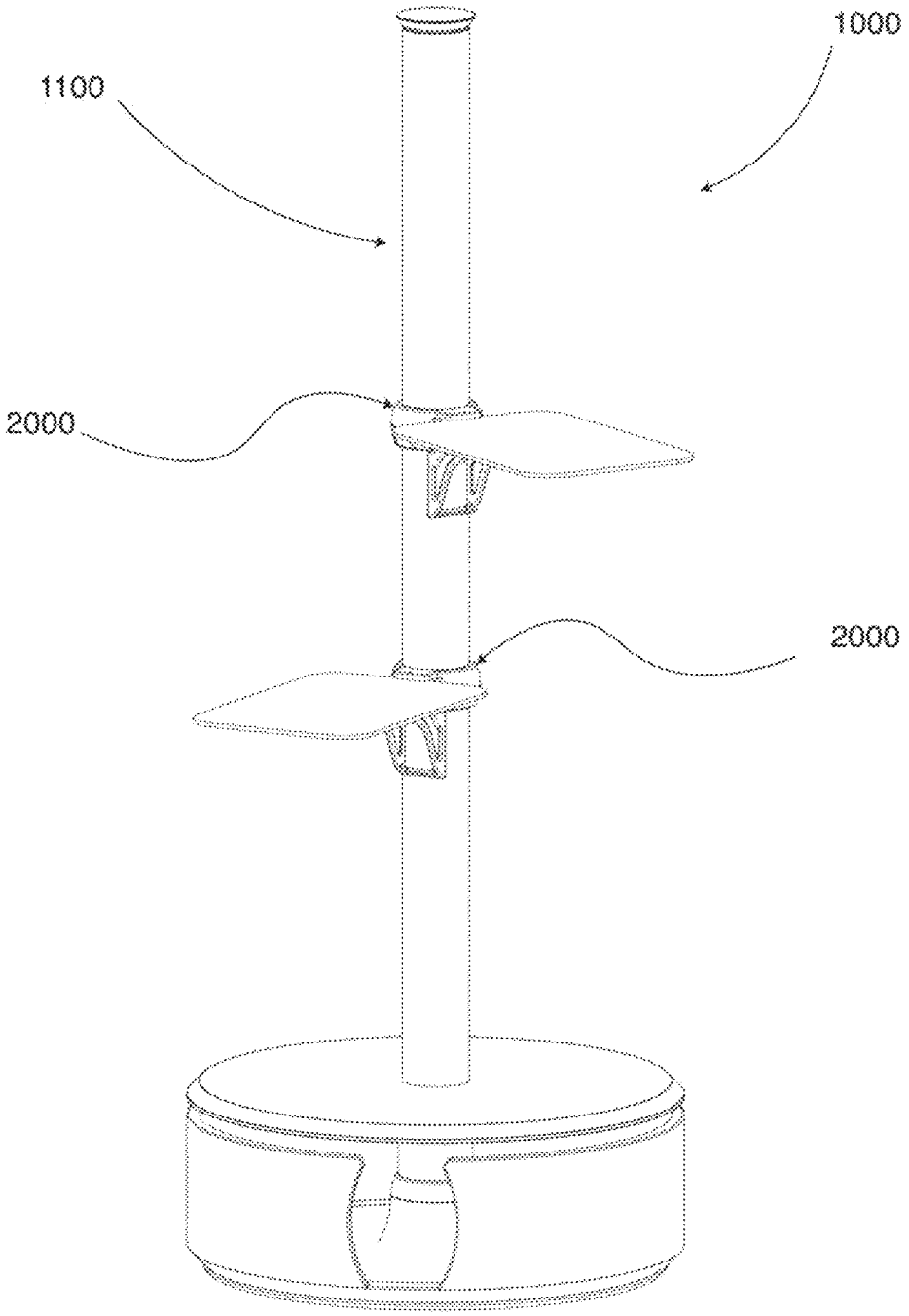
FIG. 1—A perspective view of certain embodiments of a columnar mounting system FIG. 2A—A front view of certain embodiments comprising a column FIG. 2B—A cross-sectional view of the embodiment shown in FIG. 2A FIG. 2C—A front view of certain embodiments comprising a column FIG. 2D—A cross-sectional view of the embodiment shown in FIG. 2C FIG. 3A—A perspective view of certain embodiments comprising an accessory ring FIG. 3B—A top view of certain embodiments comprising an accessory ring FIG. 4—A perspective exploded view of certain embodiments of a columnar mounting system FIG. 5A—A front view of certain embodiments of a columnar mounting system FIG. 5B—A cross-sectional view of the columnar mounting system shown in FIG. 5A FIG. 5C—A detailed view of the columnar mounting system shown in FIG. 5B FIG. 6A—A side exploded view of certain embodiments of a columnar mounting system FIG. 6B—A perspective exploded view of certain embodiments of a columnar mounting system FIG. 6C—A front view of certain embodiments comprising a column receiver comprising a column retention device FIG. 6D—A cross sectional view of the column receiver of FIG. 6C comprising a column retention device in a locked configuration FIG. 6E—A cross sectional view of the column receiver of FIG. 6C comprising a column retention device in an unlocked configuration FIG. 7A—A side view of certain embodiments of a columnar mounting system comprising a platform FIG. 7B—A top view of certain embodiments comprising a platform FIG. 8A—A side view of certain embodiments comprising an accessory ring in a locked configuration FIG. 8B—A front view of certain embodiments comprising an accessory ring in a locked configuration FIG. 8C—A cross-sectional view of the accessory ring shown in FIG. 8B FIG. 8D—A rear view of certain embodiments comprising an accessory ring with an accessory lock FIG. 8E—A cross-sectional view of the embodiment shown in FIG. 8D in an unlocked configuration FIG. 8F—A cross-sectional view of the embodiment shown in FIG. 8D in a locked configuration FIG. 9A—A front exploded view of certain embodiments comprising an accessory ring FIG. 9B—A cross-sectional view of certain embodiments comprising an accessory ring FIG. 10A—A side view of certain embodiments comprising an accessory ring in an unlocked configuration FIG. 10B—A front view of certain embodiments comprising an accessory ring in an unlocked configuration FIG. 10C—A cross-sectional view of the accessory ring shown in FIG. 10B FIG. 11A—A side view of certain embodiments of a columnar mounting system comprising a platform FIG. 11B—A cross-sectional view of the columnar mounting system shown in FIG. 11A FIG. 11C—A detailed view of the columnar mounting system shown in FIG. 11B FIG. 12A—A perspective view of certain embodiments comprising an accessory ring FIG. 12B—A top view of certain embodiments comprising an accessory ring FIG. 13A—A side view of certain embodiments comprising an accessory ring FIG. 13B—A front view of certain embodiments comprising an accessory ring FIG. 13C—A cross-sectional view of the accessory ring shown in FIG. 13B in a locked configuration FIG. 13D—A cross-sectional view of the accessory ring shown in FIG. 13B in an unlocked configuration FIG. 14A—A side view of certain embodiments comprising an accessory ring interconnected to a column with polygonal outer profile shape FIG. 14B—A front view of certain embodiments comprising an accessory ring interconnected to a column with polygonal outer profile shape FIG. 14C—A cross sectional view of the embodiment shown in FIG. 14B FIG. 14D—An exploded side view of certain embodiments comprising an accessory ring configured to interconnect with a column with polygonal outer profile shape FIG. 14E—An exploded perspective view of certain embodiments comprising an accessory ring configured to interconnect with a column with polygonal outer profile shape FIG. 15—A perspective view of certain embodiments comprising an adaptor having a tab with an aperture therethrough
Figure 2A:
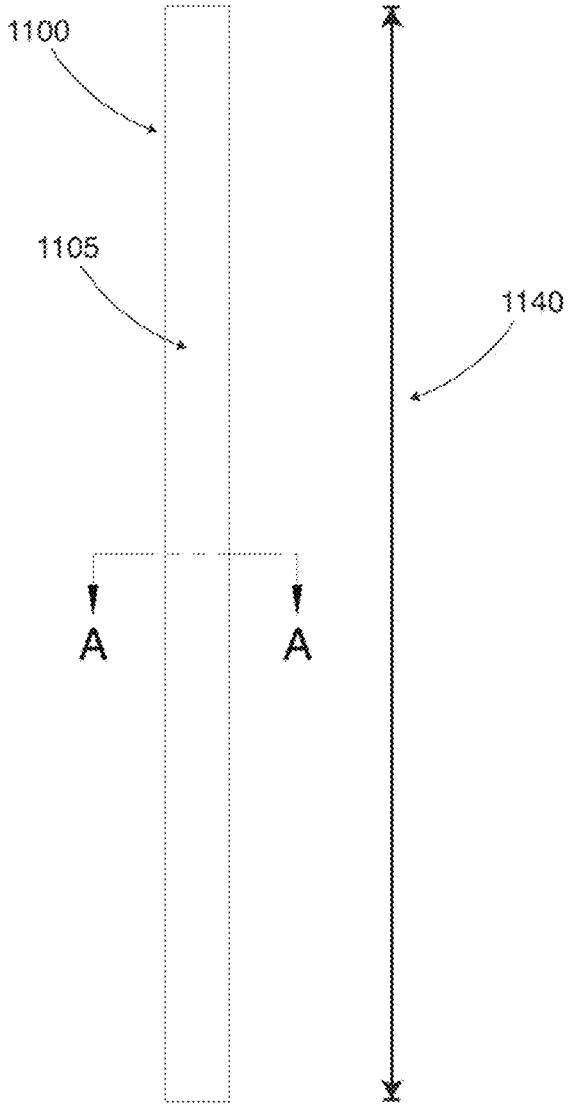
Figure 2C:
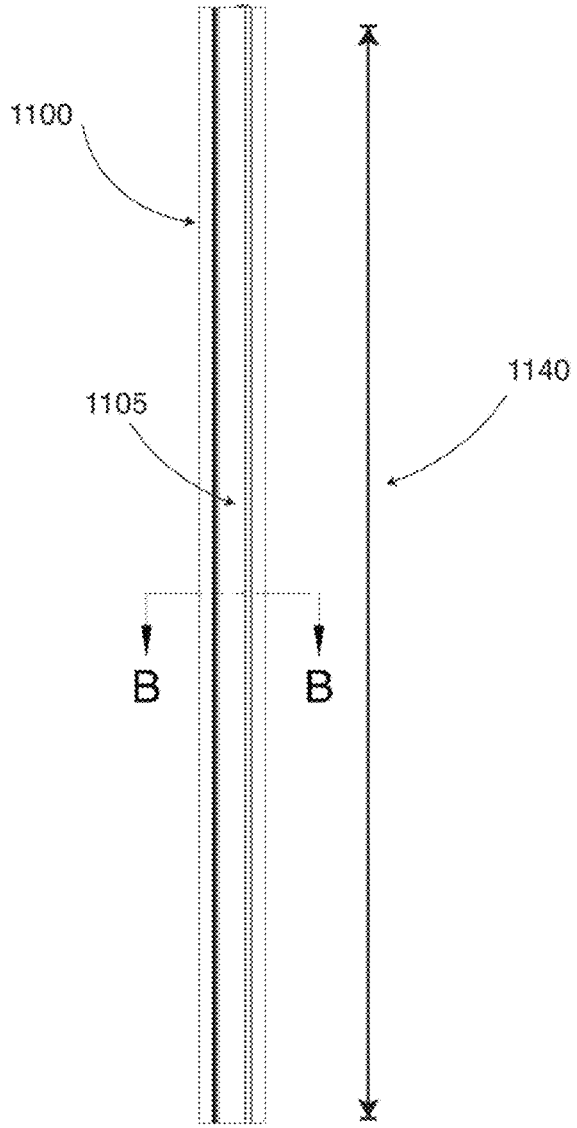
Figure 2B:
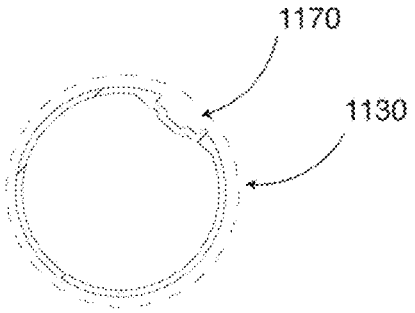
Figure 2D:
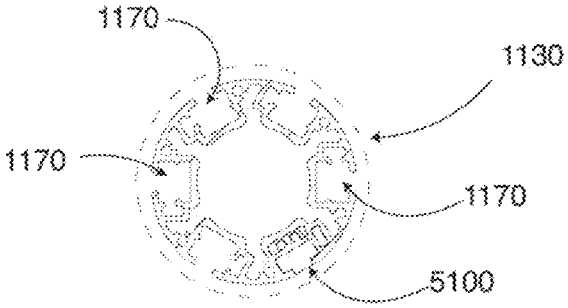
Figure 3A:
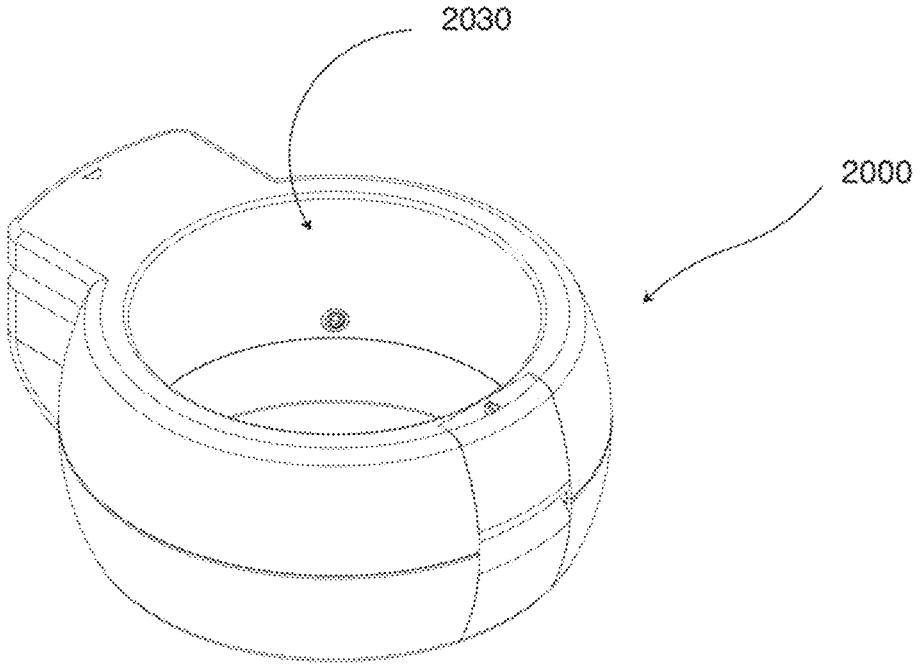
Figure 3B:
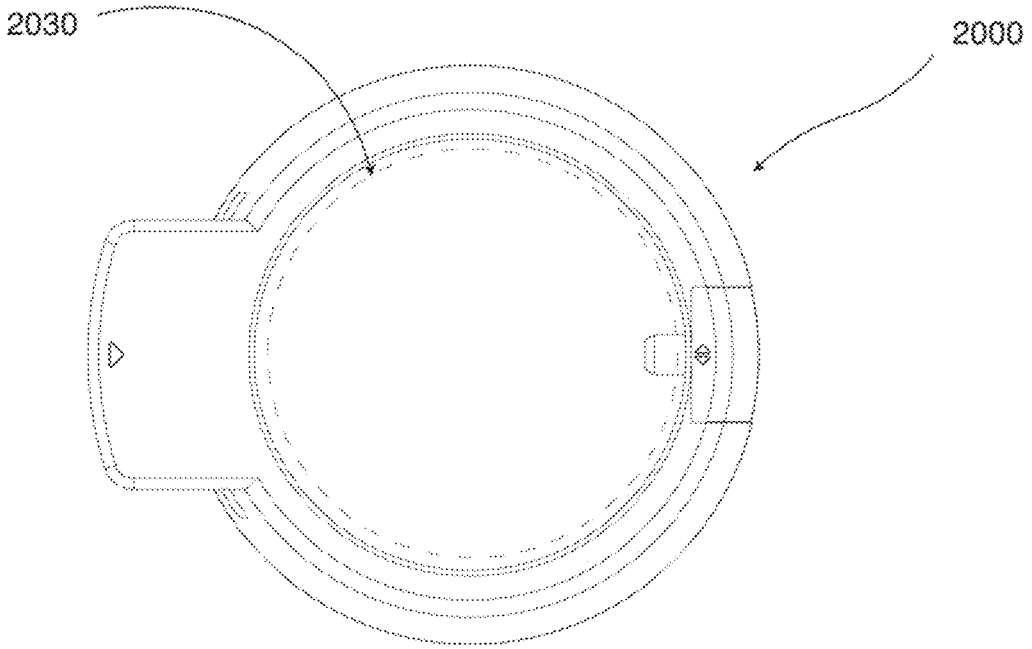

In some embodiments, such as shown in FIG. 2D, a channel 1170 comprises an LED strip 5100 disposed therein for providing lighting along the longitude of the column and to provide lighting to accessory rings and accessories interconnected with the column. Alternative embodiments comprising alternate mountings of an LED light source to the column, accessory ring, base, or otherwise to the columnar mounting system are within the spirit and scope of the present disclosure.

Figure 14C:
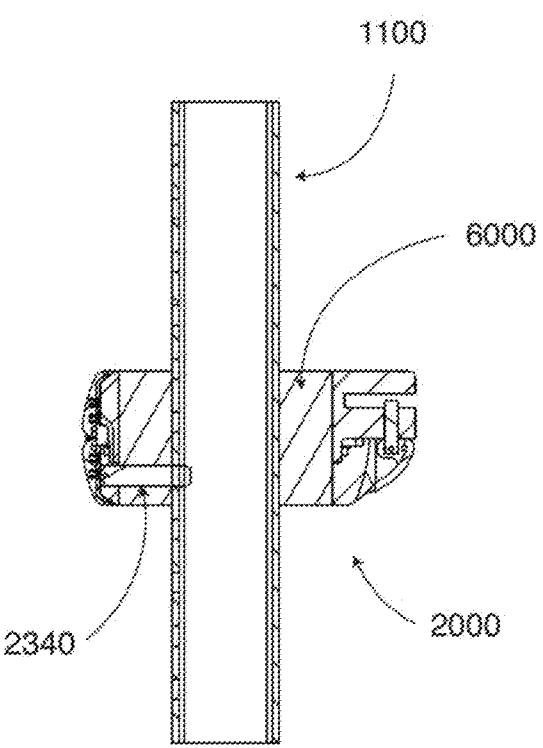
Figure 14B:
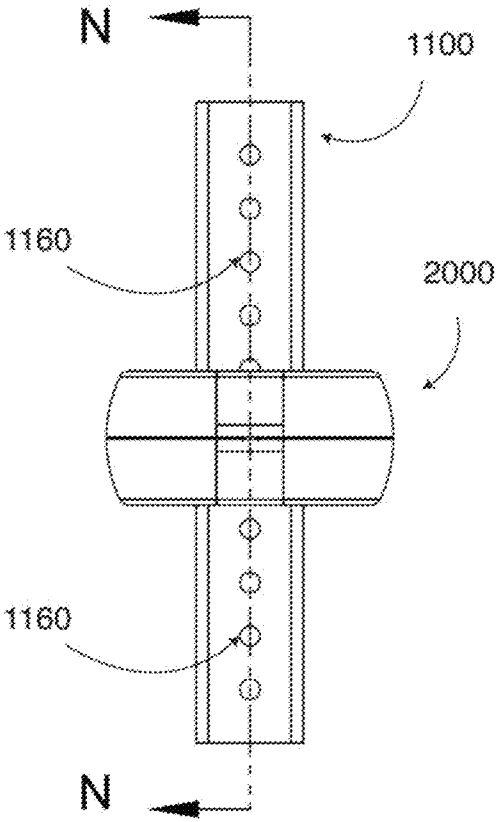
Figure 14A:
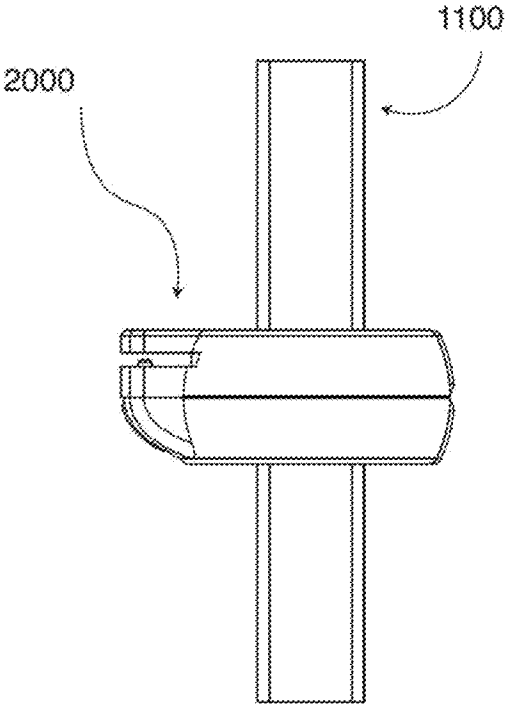
Figure 14D:
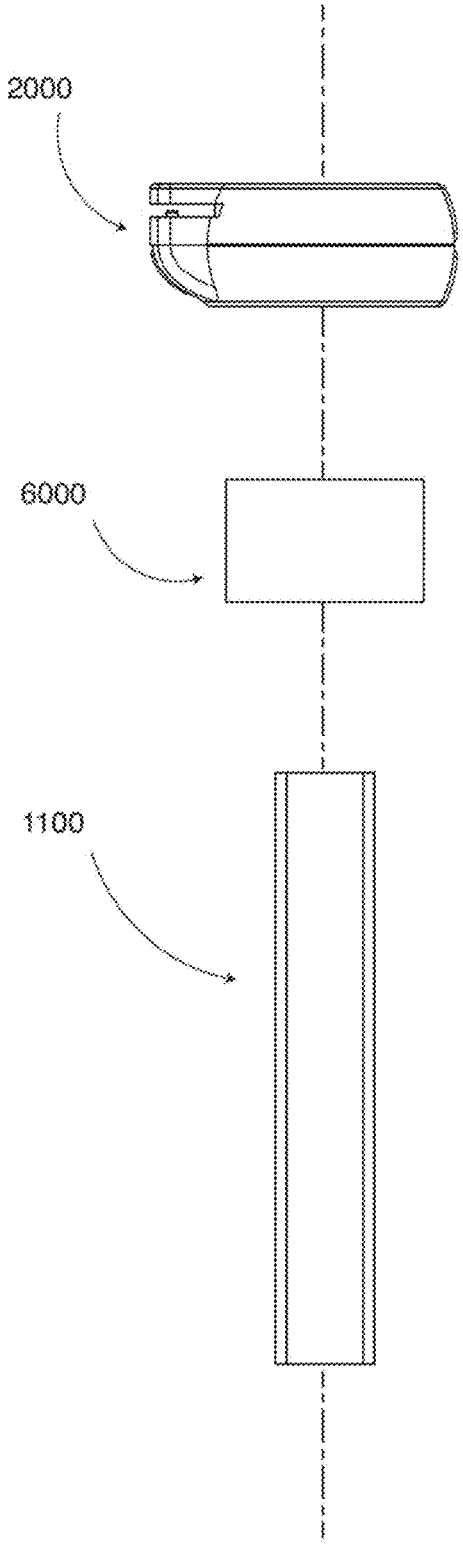
Figure 14E:
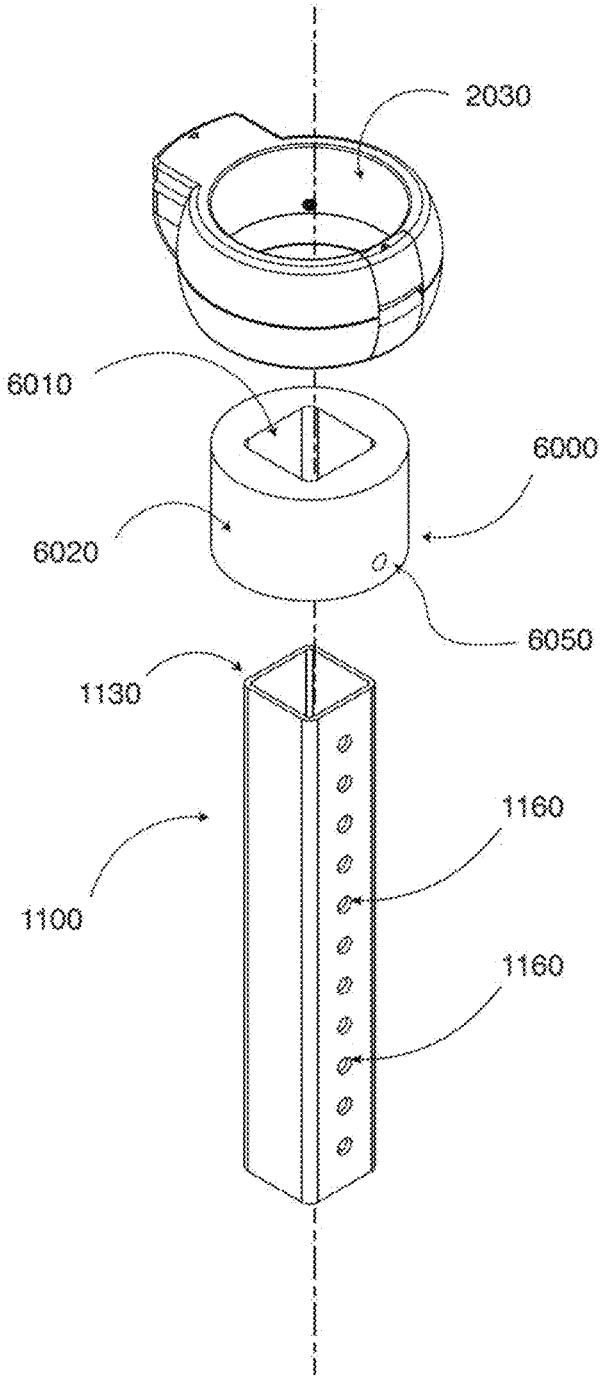

In some embodiments, as shown in FIG. 14A-FIG. 14E, comprises a column 1100 with an outer profile 1130 which is not round-such as a polygonal or elliptical shape- and further comprises an adaptor 6000 having an opening (e.g., inner profile shape 6010) matching the outer profile 1130 of the column, and an outer profile shape 6020 of the adaptor 6000 matching the opening 2030 of the accessory ring. The adaptor 6000 allows the interface between the accessory ring 2000 and the column 1100, while allowing at least a portion of the accessory ring 2000 to be rotatively adjusted in relation to the column 1100. Furthermore, the detent 2340 of the column lock 2330 extends from the accessory ring 2000, through an aperture 6050 of the adaptor ring, and into an aperture of the column 1100 in a locked configuration as shown in FIG. 14C.

Figure 15:
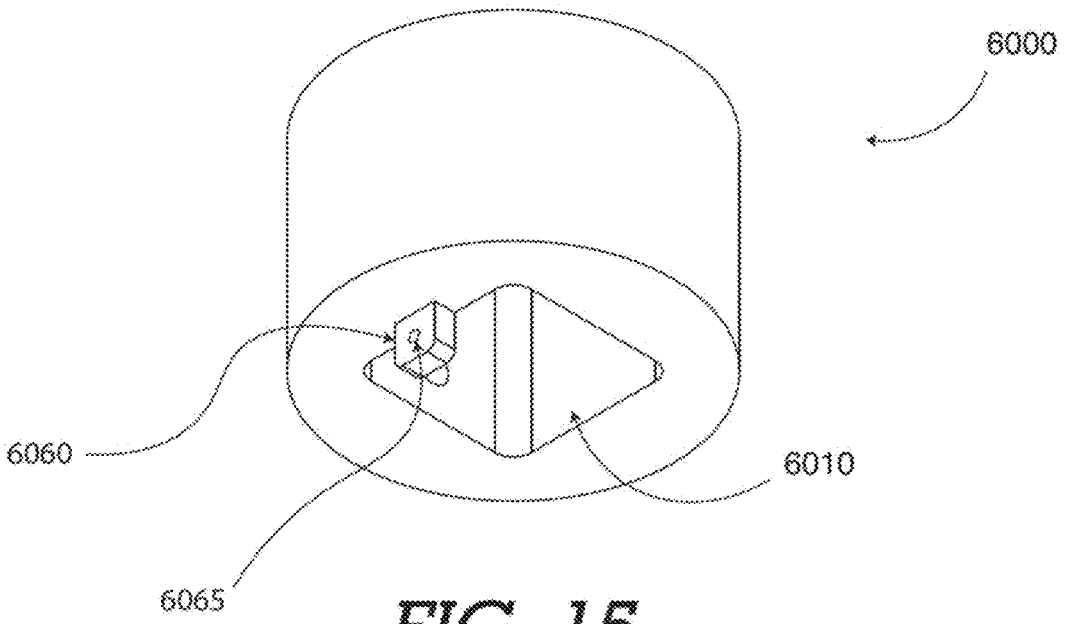

In some embodiments, as shown in FIG. 15 for example, the adaptor 6000 further comprises a tab 6060 adjacent to the inner profile shape 6010 of the adaptor, wherein a mechanical fastener, such as screw, bolt, shear pin, or otherwise, can be inserted through an aperture 6065 in the tab, thereby interconnecting the adaptor 6000 to a desired structure which is configured to be inserted through the inner profile shape 6010 of the adaptor. While embodiments shown herein comprise a tab 6060 shown interconnected to a bottom aspect 6001 of an adaptor, alternative embodiments wherein the tab 6000 is interconnected to an alternate aspect of the adaptor 6000 are within the spirit and scope of the present disclosure. Furthermore, if desired, a user in alternative embodiments may drive a screw or other mechanical fastener through the aperture 6050 of the adaptor ring and into the column 1100 (FIG. 14A-FIG. 14D). Embodiments wherein the column 1100 comprises a common dimensional wood post, a prefabricated metal post, or the like, are within the spirit and scope of the present disclosure.

In some embodiments, the actuation of a lock and/or retention device (e.g., column retention device results in a visual, audible, and/or tactile feedback that the device is in a locked configuration. For instance, in some embodiments, when the lever 3635 of the accessory lock is in an unlocked configuration (at FIG. 8E) the lever is extended outward from the accessory ring 2000, thus providing visual feedback that the accessory lock is in an unlocked configuration. Additionally or alternatively, when the lever 3635 is in a locked configuration (at FIG. 8F), the lever is retracted inward toward the accessory lock, thus providing visual feedback that the accessory lock is in a locked configuration. Additionally or alternatively, in some embodiments such as shown in FIG. 13A-13D, when the column lock 2330 is in a locked configuration and the detent 2340 is not engaged with an aperture 1160 (at FIG. 14A-14C) of the column, the push-button 2555 of the column lock appears in the unlocked position (see FIG. 13D), whereas when the detent engages with an aperture of the column, the engagement results in an audible click, and the push-button the column lock appears in the locked position (see FIG. 13C), thus providing audible and visual feedback that the column lock is in a locked configuration.

While various embodiments of the present disclosure have been described in detail, it is apparent that modifications and alterations of those embodiments will occur to those skilled in the art. However, it is to be expressly understood that such modifications and alterations are within the scope and spirit of the present disclosure. Further, the disclosure described herein is capable of other embodiments and of being practiced or of being carried out in various ways including optionally combining one or more parts of one or more embodiments to result in various embodiments not described here, and within the spirit and scope of the present disclosure. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. An accessory mounting device comprising:

an opening configured to receive an outer profile of a column through a first aspect of the accessory mounting device, and through a second aspect of the accessory mounting device, wherein the second aspect is configured to rotate independently of the first aspect about the column, and wherein the second aspect is constrained from longitudinally separating from the first aspect; and a column lock interconnected with the first aspect, wherein:

while the column lock is in a locked configuration, longitudinal movement of the accessory mounting device along the column is restricted, and while the column lock is in an unlocked configuration, the longitudinal movement of the accessory mounting device along the column is unrestricted.

2. The accessory mounting device of claim 1, wherein the column lock comprises a pin configured to interconnect with an aperture of the column, wherein:

while the column lock is in the locked configuration, the pin is extended radially inward, extending into the opening of the accessory mounting device, and while the column lock is in the unlocked configuration, the pin is retracted radially outward.

3. The accessory mounting device of claim 1, wherein the column lock is actuated via a lever, and wherein:

when the lever is in a first position, the column lock is placed in the locked configuration, and when the lever is in a second position, different than the first position, the column lock is placed in the unlocked configuration.

4. The accessory mounting device of claim 1, wherein the column lock is actuated via a push-button mechanism, wherein:

when the push-button is in a first position, the column lock is placed in the locked configuration, and when the push-button is in a second position, different than the first position, the column lock is placed in the unlocked configuration.

5. The accessory mounting device of claim 4, wherein:

when the push-button is in the first position, a push-and-release toggles the push-button mechanism to the second position, and when the push-button is in the second position, the push-and-release toggles the push-button mechanism to the first position.

6. The accessory mounting device of claim 1, further comprising:

a rotation lock, wherein:

while the rotation lock is in a locked configuration, rotation of the second aspect of the accessory mounting device, in relation to the first aspect, is restricted, and while the rotation lock is in an unlocked configuration, the rotation of the second aspect of the accessory mounting device, in relation to the first aspect, is unrestricted.

7. The accessory mounting device of claim 6, wherein the rotation lock is actuated via a lever, and wherein:

when the lever is in a first position, the rotation lock is placed in the locked configuration, and when the lever is in a second position, different than the first position, the rotation lock is placed in the unlocked configuration.

8. The accessory mounting device of claim 6, wherein the rotation lock comprises a spring which applies a force is actuated via a spring-loaded knob, wherein:

pulling the spring-loaded knob radially away from the accessory mounting device configures the rotation lock from the locked configuration, to the unlocked configuration.

9. The accessory mounting device of claim 6, wherein the rotation lock is interconnected with the second aspect, and wherein the rotation lock further comprises:

a pin, interconnected with the second aspect, configured to insert through an aperture in the first aspect in the locked configuration.

10. The accessory mounting device of claim 1, further comprising:

a keyed element, extending radially into the opening, configured to slidably interconnect with a longitudinal channel of the column.

11. The accessory mounting device of claim 10, further comprising:

a pin, extending through the keyed element, configured to insert into an aperture of the column, wherein:

when the column lock is in the locked configuration, the pin is configured to extend from the keyed element into the aperture of the column, and when the column lock in the unlocked configuration, the pin is retracted away from the opening.

12. The accessory mounting device of claim 1, further comprising:

a slot, configured to receive a tab of an accessory therein, and wherein the slot is configured to retain the tab.

13. The accessory mounting device of claim 12, wherein the slot comprises an accessory lock wherein while the tab is inserted within the slot:

while the accessory lock is in a locked configuration, movement of the tab, inserted therein, in relation to the slot is restricted, and while the accessory lock is in an unlocked configuration, movement of the tab in relation to the slot is unrestricted.

14. The accessory mounting device of claim 13, wherein the accessory lock is actuated via a lever, and wherein:

when the lever is in a first position, the accessory lock is placed in the locked configuration, and when the lever is in a second position, different than the first position, the accessory lock is placed in the unlocked configuration.

15. The accessory mounting device of claim 13, wherein the accessory lock further comprises a pin configured to extend at least partially across the slot when the accessory lock is in the locked configuration.

16. The accessory mounting device of claim 15, wherein the pin is configured to insert through an aperture in the tab of the accessory while in the locked configuration.

17. The accessory mounting device of claim 1, further comprising an adaptor, wherein an outer profile of the adaptor is configured to insert into the opening of the accessory mounting device, and wherein an opening of the adaptor comprises an inner profile configured to receive an outer profile of the column.

18. The accessory mounting device of claim 1, further comprising one or more electrical connectors, including at least of the following:

pogo pin;

bus bar;

slip ring;

inductive coil; or spring contact.

19. An accessory mounting system comprising:

a column receiver configured to interconnect with an electrical power source;

a column configured to interconnect with the column receiver; and an accessory mounting device comprising:

an opening configured to receive an outer profile of the column through a first aspect of the accessory mounting device, and through a second aspect of the accessory mounting device, wherein the second aspect is configured to rotate independently of the first aspect about the column, wherein interconnection of the column receiver to the electrical power source, the column to the column receiver, and the accessory mounting device with the column, results in electrical connection of the accessory mounting device with the electrical power source.

20. A modular columnar mounting system comprising:

a column comprising a consistent outer profile, and a channel extending longitudinally along the column;

the channel of the column comprising a plurality of apertures spaced longitudinally along the column;

a column receiver comprising a recess, the recess configured to receive a first end of the column therein, wherein the column receiver is configured to support the column in a vertical orientation;

an accessory ring comprising an opening, wherein the opening is configured to receive an outer profile of the column slidably therethrough;

the accessory ring comprising a first aspect comprising an annular shape, and the first aspect of the accessory ring comprises a column lock;

the column lock comprises a detent configured to insert into one of the plurality of apertures of the channel, wherein when the column lock is in an unlocked configuration, the detent of the column lock is withdrawn from the plurality of apertures of the channel and the accessory ring is slidably adjustable longitudinally along the column, and wherein when the column lock is in a locked configuration, the detent of the column lock is inserted into one of the plurality of apertures of the channel, and the accessory ring is longitudinally constrained along the column;

the accessory ring further comprises a second aspect comprising an annular shape, and the second aspect is configured to nest with the first aspect, and wherein the second aspect of the accessory ring is configured to be rotatively adjustable in relation to the first aspect;

the second aspect further comprises a rotation lock; and the rotation lock comprises a detent configured to insert into one of a plurality of notches in the first aspect of the accessory ring, wherein when the rotation lock is in an unlocked configuration, the detent of the rotation lock is withdrawn from the notches and the second aspect of the accessory ring is rotatively adjustable in relation to the first aspect, and wherein when the rotation lock is in a locked configuration, the detent of the rotation lock is inserted into one of the plurality of notches, thereby rotatively constraining the second aspect in relation to the first aspect of the accessory ring.

* * * * *